US010124349B2

(12) United States Patent
Erickson et al.

(10) Patent No.: US 10,124,349 B2
(45) Date of Patent: Nov. 13, 2018

(54) MULTI-FUNCTION SPLASHLESS SPRAYHEAD

(71) Applicant: Kohler Co., Kohler, WI (US)

(72) Inventors: Perry D. Erickson, Sheboygan, WI (US); Steven Thomas Radder, Kiel, WI (US); Amruta Velapure, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 6 days.

(21) Appl. No.: 15/651,175

(22) Filed: Jul. 17, 2017

(65) Prior Publication Data

US 2017/0312766 A1 Nov. 2, 2017

Related U.S. Application Data

(63) Continuation of application No. 14/975,131, filed on Dec. 18, 2015, now Pat. No. 9,707,572.

(51) Int. Cl.
*B05B 1/10* (2006.01)
*B05B 1/12* (2006.01)
(Continued)

(52) U.S. Cl.
CPC ..... *B05B 1/12* (2013.01); *B05B 1/169* (2013.01); *B05B 1/1618* (2013.01);
(Continued)

(58) Field of Classification Search
CPC ..... B05B 1/185; B05B 1/30; B05B 1/3026; B05B 1/3033; B05B 1/16; B05B 1/1627;
(Continued)

(56) References Cited

U.S. PATENT DOCUMENTS 1,823,635 A 9/1931 Williams
2,127,188 A 8/1938 Schellin et al.
(Continued)

FOREIGN PATENT DOCUMENTS

CA 2155433 A1 7/1994
CN 201651426 U 11/2010
(Continued)

OTHER PUBLICATIONS

EP Communication regarding Application No. 14159657.7 dated Mar. 31, 2016 (6 pages).
(Continued)

*Primary Examiner* — Viet Le
(74) *Attorney, Agent, or Firm* — Foley & Lardner LLP

(57) ABSTRACT

A fluid control valve includes a body, a first diverter, a second diverter, and a first actuator. The body includes an inlet configured to receive a supply of fluid. The first diverter is movable in a radial direction within the body between a first radial position and a second radial position. The second diverter is movable in a longitudinal direction within the body between a first longitudinal position and a second longitudinal position. The first actuator is operatively coupled to the first diverter and to the second diverter. The first actuator is configured to simultaneously move the first diverter between the first and second radial positions and the second diverter between the first and second longitudinal positions.

20 Claims, 26 Drawing Sheets

(51) Int. Cl.

| | |
|---|---|
| ***B05B 1/16*** | (2006.01) |
| ***B05B 1/18*** | (2006.01) |
| ***B05B 1/30*** | (2006.01) |
| ***E03C 1/04*** | (2006.01) |
| ***E03C 1/08*** | (2006.01) |

(52) U.S. Cl.
CPC ..... *B05B 1/1627* (2013.01); *B05B 1/1681* (2013.01); *B05B 1/18* (2013.01); *B05B 1/3026* (2013.01); *E03C 1/0405* (2013.01); *E03C 1/08* (2013.01); *E03C 2001/0415* (2013.01); *E03C 2201/30* (2013.01)

(58) Field of Classification Search
CPC ... B05B 1/1663; B05B 1/1618; B05B 1/1681; B05B 1/0405; E03C 1/08; E03C 2201/03; E03C 2001/0415
USPC ..... 239/436–499
See application file for complete search history.

(56) References Cited

U.S. PATENT DOCUMENTS

| | | | |
|---|---|---|---|
| 3,346,148 | A | 10/1967 | Weese |
| 3,524,591 | A | 8/1970 | Samuels et al. |
| 3,739,983 | A | 6/1973 | Jousson |
| 4,107,046 | A | 8/1978 | Corder |
| 4,130,120 | A | 12/1978 | Kohler, Jr. |
| 4,398,669 | A | 8/1983 | Fienhold |
| 4,528,070 | A | 7/1985 | Gamblin |
| 4,617,965 | A | 10/1986 | Lorch |
| 4,651,770 | A | 3/1987 | Denham et al. |
| 4,794,952 | A | 1/1989 | Burkard |
| 5,022,429 | A | 6/1991 | Rollini et al. |
| 5,103,856 | A | 4/1992 | Fleischmann |
| 5,127,111 | A | 7/1992 | Sieth |
| 5,145,114 | A | 9/1992 | Monch |
| 5,201,468 | A | 4/1993 | Freier et al. |
| 5,205,490 | A | 4/1993 | Steinhardt et al. |
| 5,253,811 | A | 10/1993 | Sieth |
| 5,299,743 | A | 4/1994 | Sieth et al. |
| 5,361,431 | A | 11/1994 | Freier et al. |
| 5,575,424 | A | 11/1996 | Fleischmann |
| 5,577,664 | A | 11/1996 | Heitzman |
| 5,608,927 | A | 3/1997 | Lowry et al. |
| 5,752,541 | A | 5/1998 | Gonzalez |
| 5,772,120 | A | 6/1998 | Huber |
| 5,806,771 | A | 9/1998 | Loschelder et al. |
| 5,918,811 | A | 7/1999 | Denham et al. |
| 5,961,046 | A | 10/1999 | Joubran |
| 6,134,722 | A | 10/2000 | Lowry et al. |
| 6,164,566 | A | 12/2000 | Hui-Chen |
| 6,202,693 | B1 | 3/2001 | Bollo |
| 6,233,757 | B1 | 5/2001 | Graham et al. |
| 6,234,192 | B1 | 5/2001 | Esche et al. |
| 6,296,011 | B1 | 10/2001 | Esche et al. |
| 6,302,339 | B1 | 10/2001 | Chou |
| 6,367,710 | B2 | 4/2002 | Fan |
| 6,370,713 | B2 | 4/2002 | Bosio |
| 6,412,711 | B1 | 7/2002 | Fan |
| 6,533,194 | B2 | 3/2003 | Marsh et al. |
| 6,607,148 | B1 | 8/2003 | Marsh et al. |
| 6,612,507 | B1 | 9/2003 | Meyer et al. |
| 6,634,380 | B2 | 10/2003 | Bartkus et al. |
| 6,659,372 | B2 | 12/2003 | Marsh et al. |
| 6,757,921 | B2 | 7/2004 | Esche |
| 6,959,731 | B2 | 11/2005 | Bartkus et al. |
| 7,004,409 | B2 | 2/2006 | Okubo |
| 7,070,125 | B2 | 7/2006 | Williams et al. |
| 7,134,614 | B2 | 11/2006 | Miyake et al. |
| 7,322,535 | B2 | 1/2008 | Erdely |
| 7,341,239 | B2 | 3/2008 | Hodel |
| 7,344,094 | B1 | 3/2008 | Tracy et al. |
| 7,373,950 | B2 | 5/2008 | Huang |
| 7,455,247 | B2 | 11/2008 | Kajuch |
| 7,487,797 | B2 | 2/2009 | Di Nunzio |
| 7,494,074 | B2 | 2/2009 | Benstead |
| 7,578,453 | B1 | 8/2009 | Wilson |
| 7,628,341 | B2 | 12/2009 | Kajuch |
| 7,753,074 | B2 | 7/2010 | Rosko et al. |
| 7,762,479 | B2 | 7/2010 | Li |
| 7,770,820 | B2 | 8/2010 | Clearman et al. |
| 7,770,825 | B2 | 8/2010 | Kajuch |
| 7,789,326 | B2 | 9/2010 | Luettgen et al. |
| 7,850,098 | B2 | 12/2010 | Vogel et al. |
| 7,871,020 | B2 | 1/2011 | Nelson et al. |
| 7,909,269 | B2 * | 3/2011 | Erickson ..... B05B 1/1618 137/801 |
| 8,070,076 | B2 | 12/2011 | Erickson et al. |
| 8,113,442 | B2 | 2/2012 | Li et al. |
| 8,205,812 | B2 | 6/2012 | Hester et al. |
| 8,360,346 | B2 | 1/2013 | Furseth |
| 8,448,667 | B2 * | 5/2013 | Meehan ..... E03C 1/0404 137/637.1 |
| 8,733,674 | B2 | 5/2014 | Kajuch |
| 8,863,769 | B2 | 10/2014 | Andersen et al. |
| 8,876,023 | B2 | 11/2014 | Peel et al. |
| 9,707,572 | B2 * | 7/2017 | Erickson ..... B05B 1/1618 |
| 2002/0148516 | A1 | 10/2002 | Bartkus et al. |
| 2005/0001072 | A1 | 1/2005 | Bolus et al. |
| 2005/0145554 | A1 | 7/2005 | Cunningham et al. |
| 2006/0016912 | A1 | 1/2006 | Nobili |
| 2007/0194148 | A1 | 8/2007 | Rosko et al. |
| 2007/0246577 | A1 | 10/2007 | Leber |
| 2007/0276578 | A1 | 11/2007 | Bulan et al. |
| 2008/0023577 | A1 | 1/2008 | Zhen et al. |
| 2008/0067264 | A1 | 3/2008 | Erickson et al. |
| 2008/0105764 | A1 | 5/2008 | Jianglin et al. |
| 2008/0156902 | A1 | 7/2008 | Luettgen et al. |
| 2009/0236438 | A1 | 9/2009 | Petrovic |
| 2010/0006169 | A1 | 1/2010 | Bolgar et al. |
| 2010/0125946 | A1 | 5/2010 | Meisner et al. |
| 2010/0276518 | A1 | 11/2010 | Kajuch |
| 2011/0079657 | A1 | 4/2011 | Vogel et al. |
| 2011/0139886 | A1 | 6/2011 | Peng |
| 2011/0147477 | A1 | 6/2011 | Mang |
| 2011/0198415 | A1 | 8/2011 | Ukigai et al. |
| 2011/0198416 | A1 | 8/2011 | Ukigai et al. |
| 2011/0284662 | A1 | 11/2011 | Ohashi et al. |
| 2012/0267455 | A1 | 10/2012 | Hansen |
| 2013/0193237 | A1 | 8/2013 | Erickson |
| 2014/0026980 | A1 | 1/2014 | Esche et al. |
| 2014/0069511 | A1 | 3/2014 | Rexach et al. |
| 2014/0069520 | A1 | 3/2014 | Esche et al. |
| 2014/0263760 | A1 | 9/2014 | Hanna et al. |
| 2016/0136659 | A1 | 5/2016 | Erickson et al. |

FOREIGN PATENT DOCUMENTS

| | | |
|---|---|---|
| CN | 102160765 | 8/2011 |
| CN | 102161023 | 8/2011 |
| CN | 102316778 | 1/2012 |
| DE | 28 43 666 A1 | 4/1980 |
| DE | 411850 A1 | 12/1992 |
| EP | 0 688 607 A1 | 12/1995 |
| EP | 1477229 | 11/2004 |
| EP | 2 359 726 A1 | 8/2011 |
| EP | 2 361 688 A1 | 8/2011 |
| EP | 2 361 689 A1 | 8/2011 |
| EP | 2777819 | 6/2017 |
| JP | 402142638 | 12/1990 |
| JP | H0742518 | 10/1995 |
| JP | 2006188831 | 7/2006 |
| JP | 2007138662 | 6/2007 |
| JP | 2010-162356 | 7/2010 |
| JP | 2010-162532 | 7/2010 |
| JP | 2010-162534 | 7/2010 |
| JP | 2010-162535 | 7/2010 |
| JP | 04-623329 | 2/2011 |
| JP | 2011-167355 | 9/2011 |
| JP | 2011-167640 | 9/2011 |
| WO | WO-94/7065 | 3/1994 |

(56) References Cited

FOREIGN PATENT DOCUMENTS

| | | |
|---|---|---|
| WO | WO-95/17971 | 7/1995 |
| WO | WO2007/092850 | 8/2007 |
| WO | WO-01/70904 | 6/2010 |

OTHER PUBLICATIONS

European Search Report and Search Opinion for Application No. EP 14150082, dated Apr. 7, 2014, 5 pages.
European Search Report dated Apr. 13, 2016, from related European patent application EP No. 15195248.8.
European Search Report dated Jun. 16, 2014 for Application No. 14159657.7, 6 pages.
EP European Search Report re Application No. 171700552.2 dated Sep. 5, 2017.

* cited by examiner

MULTI-FUNCTION SPLASHLESS SPRAYHEAD

CROSS-REFERENCE TO RELATED PATENT APPLICATIONS

This application is a Continuation of U.S. patent application Ser. No. 14/975,131, filed Dec. 18, 2015 (now U.S. Pat. No. 9,707,572), the entire disclosure of which is hereby incorporated by reference herein.

BACKGROUND

The present disclosure relates generally to the field of valves for directing fluids to multiple outlets. More specifically, the disclosure relates to sprayhead assemblies for use in faucets for directing fluid (e.g., water) to one or more outlets to thereby provide multiple functions of the sprayhead.

Faucets may include a body and a sprayhead from which water is emitted. Conventional sprayheads may include a valve for switching between two functions, for example, aerated and non-aerated water streams. There is a need for an improved valve to distribute water between functional outlets. There is a further need for a valve that provides a sprayhead having more than two functions.

SUMMARY

An embodiment relates to a fluid control valve including a body, a first diverter, a second diverter, and a first actuator. The body includes an inlet configured to receive a supply of fluid. The first diverter is movable in a radial direction within the body between a first radial position and a second radial position. The second diverter is movable in a longitudinal direction within the body between a first longitudinal position and a second longitudinal position. The first actuator is operatively coupled to the first diverter and to the second diverter. The first actuator is configured to simultaneously move the first diverter between the first and second radial positions and the second diverter between the first and second longitudinal positions.

Another embodiment relates to a sprayhead for directing a fluid. The sprayhead includes a fluid control valve, a first outlet member, a second outlet member, and a third outlet member. The fluid control valve includes a body, a first diverter, and a second diverter. The body includes an inlet configured to receive the fluid. The first diverter is movable in a radial direction between a first radial position and a second radial position. The second diverter is movable in a longitudinal direction between a first longitudinal position and a second longitudinal position. The first outlet member includes a first plurality of nozzles configured to receive the fluid to provide a first spray. The second outlet member includes at least one nozzle configured to receive the fluid to provide a second spray different than the first spray. The third outlet member surrounds the first outlet member and includes a second plurality of nozzles configured to receive the fluid to provide a third spray different than the first and second sprays. The third spray is provided simultaneously with the first spray when the first spray is being provided.

Yet another embodiment relates to a sprayhead for directing a fluid. The sprayhead includes a fluid control valve and an outlet member. The fluid control valve includes a body including an inlet configured to receive the fluid. The outlet member is removably coupled to the body and includes a plurality of nozzles configured to receive the fluid from the body. The outlet member comprises a spray surface having a hyperbolic-paraboloid shape configured to provide a spray pattern having an elliptical cross-sectional shape.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
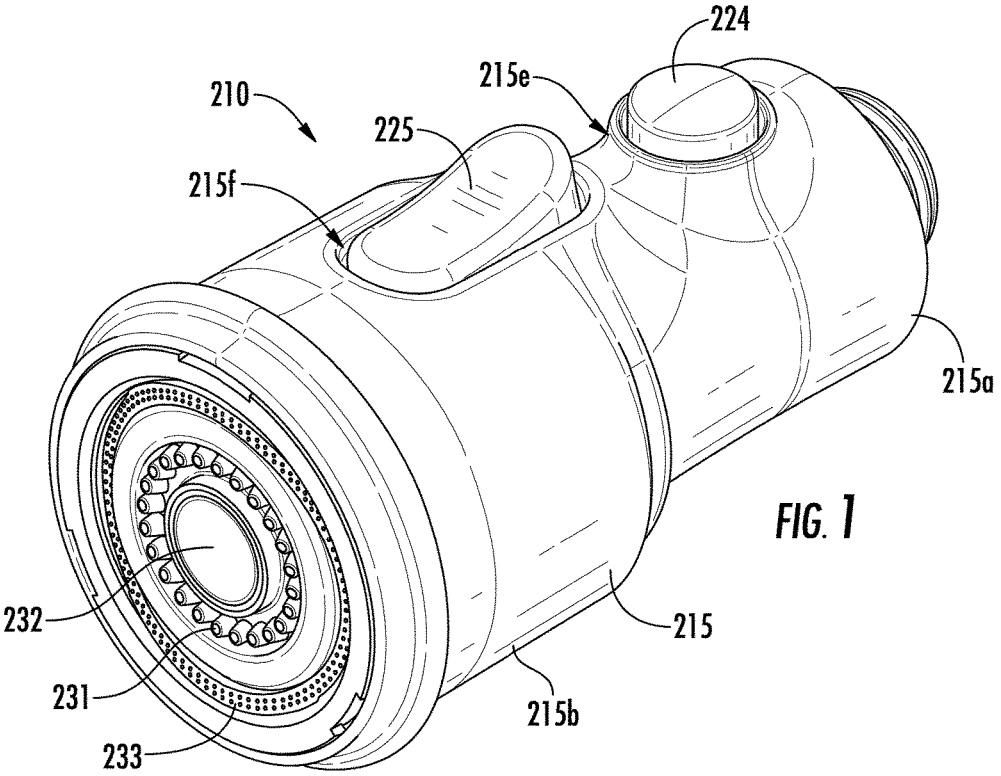
FIG. 1 is a front perspective view of an exemplary embodiment of a sprayhead.

Referring generally to the FIGURES, disclosed herein are sprayheads configured to provide multiple spray functions. The sprayheads may be configured for use with faucets or may be separate sprayers (e.g., side sprayers). The sprayhead includes a valve (e.g., a fluid control valve) having one or more chambers. For example, the valve may include a body that defines a first chamber, a second chamber, and a third chamber. The sprayhead also includes an inlet configured to receive a supply of fluid (e.g., water). For example, the body may include the inlet. The valve also includes at least one diverter. For example, the valve may include a first diverter and a second diverter. The first diverter is movable between a first position and a second position. According to an exemplary embodiment, when the first diverter is in the second position, the first and second chambers are fluidly connected to the inlet; and when the first diverter is in the first position, the second chamber is fluidly connected to the inlet and the first chamber is fluidly disconnected from the inlet. The second diverter is movable between a first position and a second position. According to an exemplary embodiment, when the second diverter is in the second position, the third chamber is fluidly connected to the second chamber; and wherein when the second diverter is in the first position, the third chamber is fluidly disconnected from the second chamber. The valve, such as the body, may include one or more outlets. For example, the body may include a first outlet, a second outlet, and a third outlet. The first outlet may be fluidly connected to the first chamber and the third outlet may be fluidly connected to the third chamber. According to an exemplary embodiment, when the second diverter is in the first position, the second outlet is fluidly connected to the second chamber, and when the second diverter is in the second position, the second outlet is fluidly disconnected from the second chamber.

The sprayhead may include one or more outlet members, where each outlet member is configured to provide a different spray function (e.g., mode of operation). For example, the sprayhead may include a first outlet member, a second outlet member, and a third outlet member. The first outlet member may include a first plurality of nozzles that receive the fluid from the first chamber. The second outlet member may include at least one nozzle that is fluidly connected to the second chamber when the second diverter is in the first position. The third outlet member may include a second plurality of nozzles that receive the fluid from the third chamber. The first plurality of nozzles provide a first spray, the at least one nozzle of the second outlet member provides a second spray different than the first spray, and the second plurality of nozzles provide a third spray different than the first and second sprays. According to an exemplary embodiment, the sprayhead is configured to provide multiple spray functions simultaneously, such as the first spray from the first plurality of nozzles and the third spray from the third plurality of nozzles.

A faucet sprayhead may include a valve which directs water between an aerated outlet and a non-aerated outlet. However, as faucet technology improves and specialized spray patterns may be used to more efficiently use water, there is a need for a valve which can distribute water to multiple functional outlets. According to various embodiments, the sprayhead has three or more possible functions. According to the exemplary embodiment shown, the sprayhead has three possible functions.

FIGS. 1-9B illustrate an exemplary embodiment of a sprayhead 210 configured as a multi-function sprayer. The sprayhead 210 includes a valve 239 for controlling a flow of fluid (e.g., water) through the sprayhead 210 and at least one outlet (e.g., a member outlet) configured to direct the fluid exiting the sprayhead 210. The sprayhead 210 further includes at least one actuator configured to control operation of the valve 239 to switch between the two or more spraying functions. Each actuator may be configured as a toggle, a switch, a button 224, or other suitable configurations. The sprayhead 210 may include one or more features (e.g., studs, pivots, guides, bosses, protrusions, axles, etc.) that are configured to guide and/or facilitate movement of the actuator. Actuation of the actuator causes a change in operation (e.g., volume control, function control, etc.) of the sprayhead 210. The actuator(s) and function of the sprayhead 210 are described in more detail below.

Figure 7:
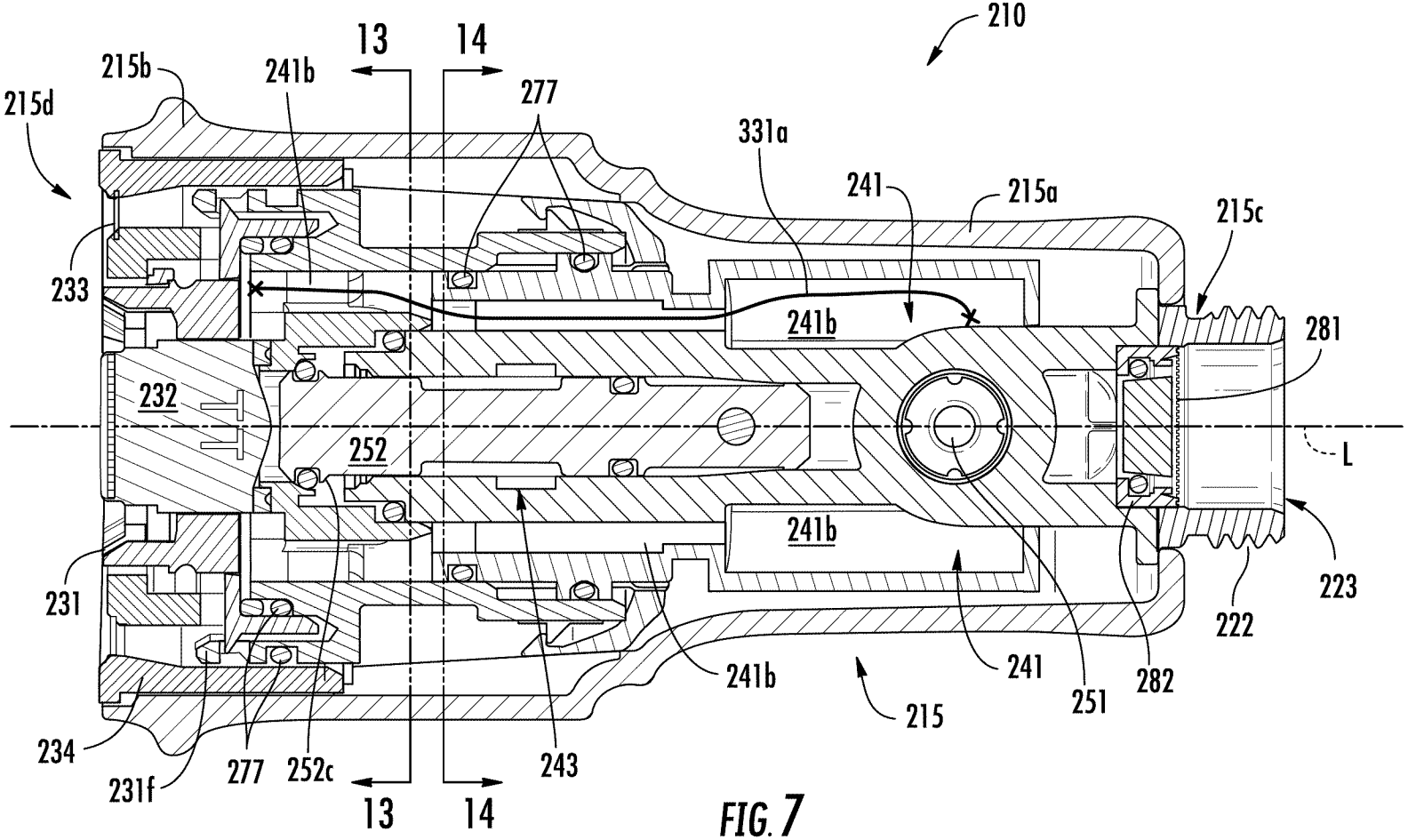
FIG. 7 is a top cross-sectional view of the sprayhead through line 7-7 of FIG. 6.

As shown in FIG. 7, the sprayhead 210 extends along a longitudinal axis L and includes an inlet 223 configured to receive a supply of fluid. The sprayhead 210 may include a connector 222 configured to couple the sprayhead 210 to another member, such as a faucet, a supply hose, etc. The connector 222 may be configured proximate the inlet 223. For example, the connector 222 may define the inlet 223, which is fluidly connected to (e.g., in fluid communication with) the valve 239 of the sprayhead 210 to introduce the fluid into the valve 239. According to an exemplary embodiment, the connector 222 is configured to detachably couple to a hose through threads, where the hose extends through a spout of a faucet such that the sprayhead 10 is fluidly coupled to the faucet. The hose may have a telescopic arrangement (e.g., configuration, connection, etc.) relative to the spout. In other words, the connection allows the sprayhead 210 to be decoupled from the faucet and the hose extracted from the spout, and also allows the hose to be retracted into the spout and the sprayhead 210 to be coupled to the faucet.

Figure 6:
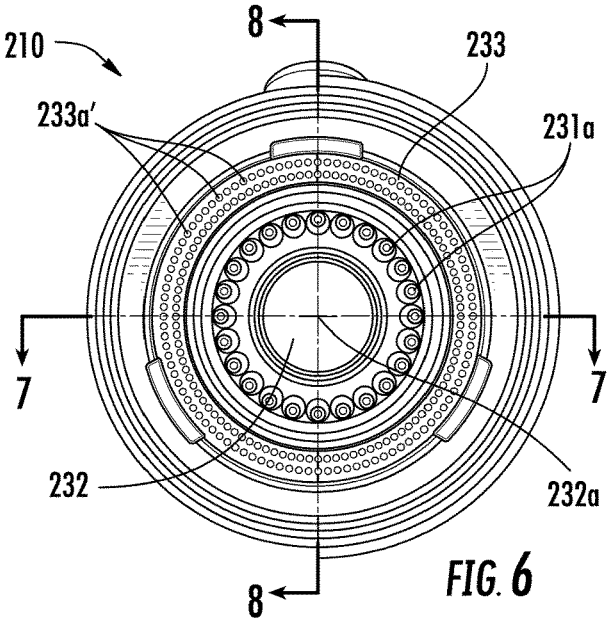
FIG. 6 is a front view of the sprayhead of FIG. 1.

The fluid directed into the inlet 223 flows to the one or more outlets (e.g., outlet members, etc.), which are generally located opposite the inlet 223. As shown in FIGS. 1 and 6, the sprayhead 210 includes a first outlet member 231, a second outlet member 232, and a third outlet member 233.

Figure 31:
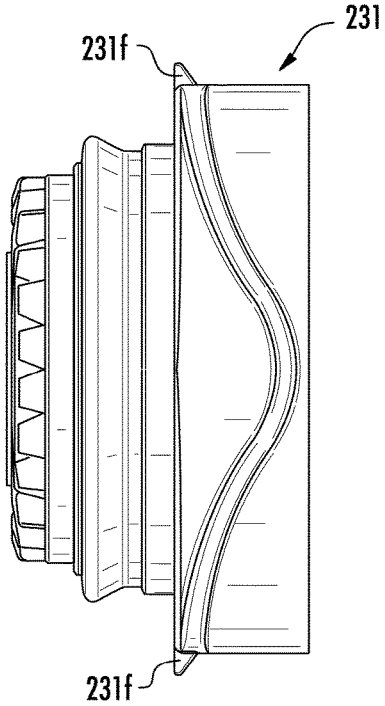
FIG. 31 is a top view of the outlet member of FIG. 29.
Figure 32:
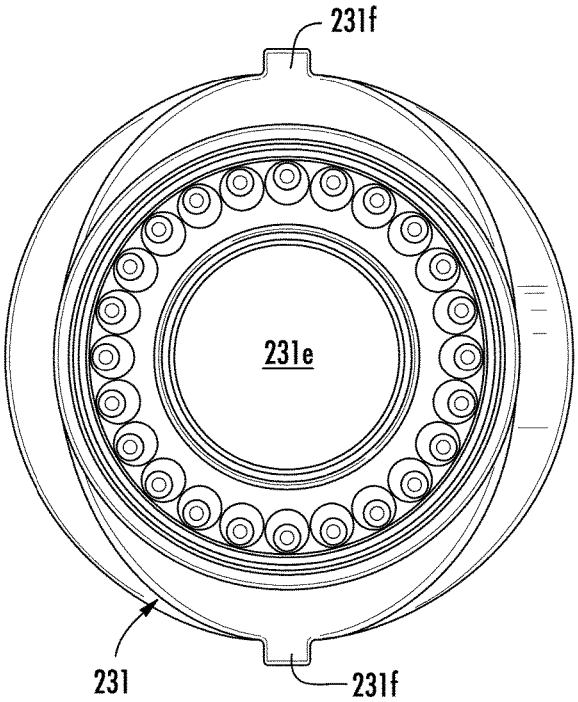
FIG. 32 is a front view of the outlet member of FIG. 29.
Figure 33:
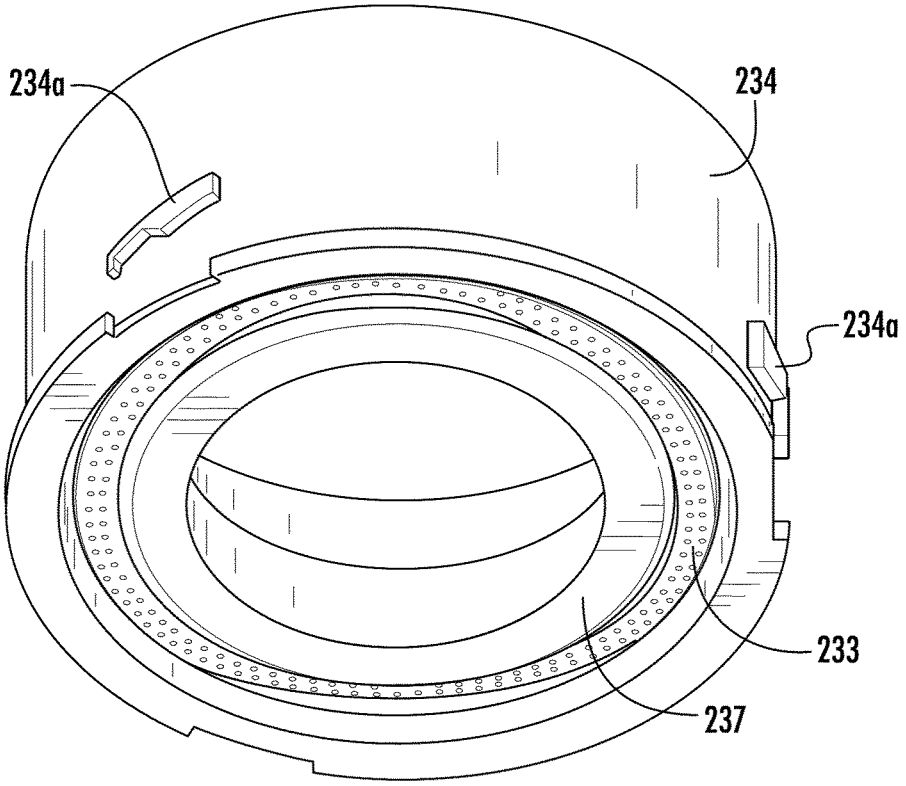
FIG. 33 is a front perspective view of another exemplary embodiment of an outlet member of a sprayhead.
Figure 34:
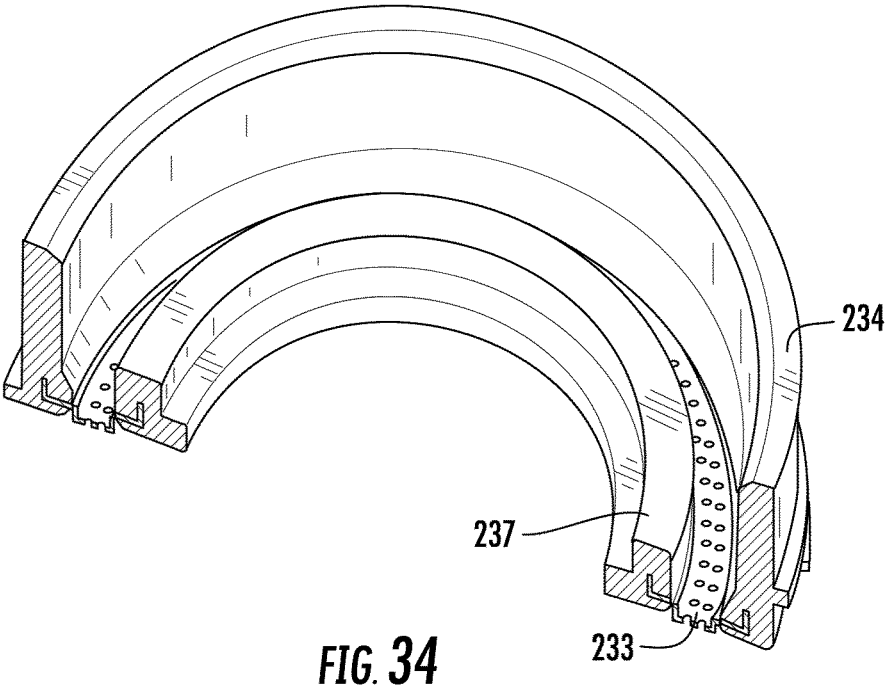
FIG. 34 is a cutaway perspective view of the outlet member of FIG. 33.
Figure 35:
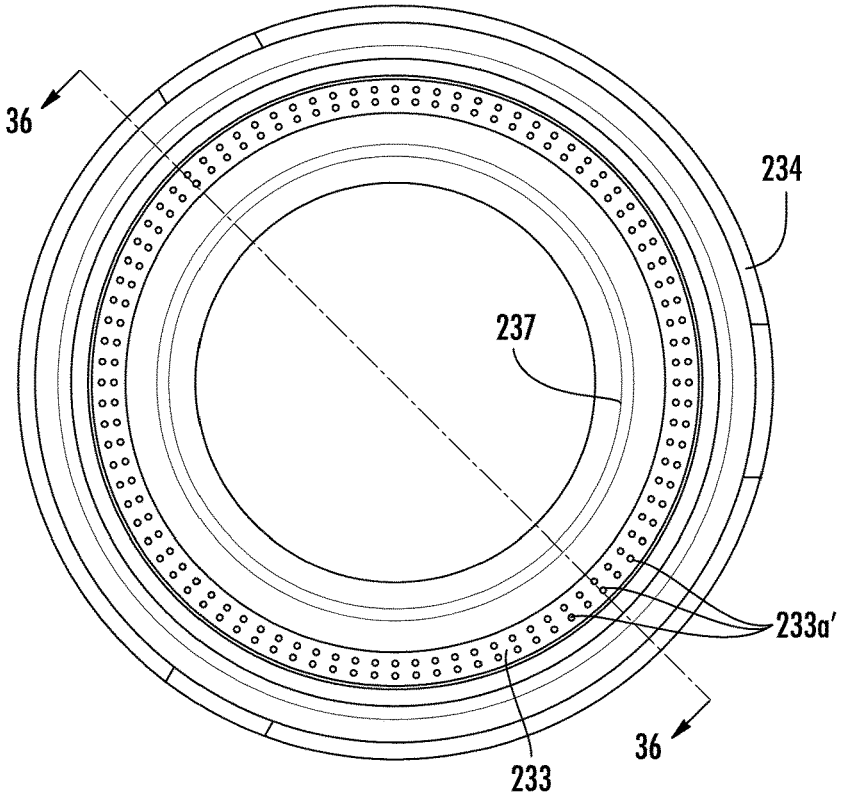
FIG. 35 is a front view of the outlet member of FIG. 33.
Figure 36:
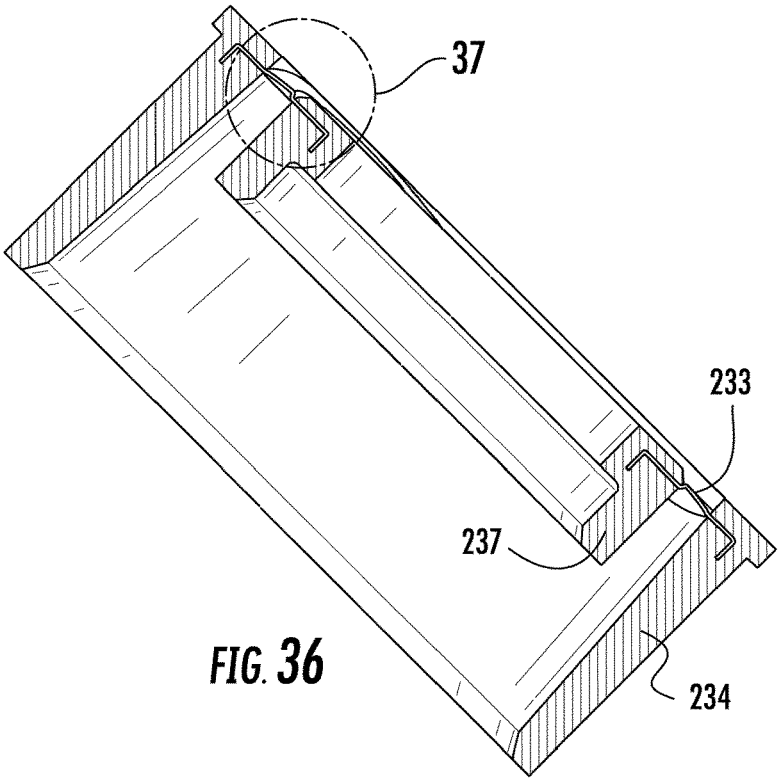
FIG. 36 is a cross-sectional view of the outlet member through line 36-36 of FIG. 35.
Figure 37:
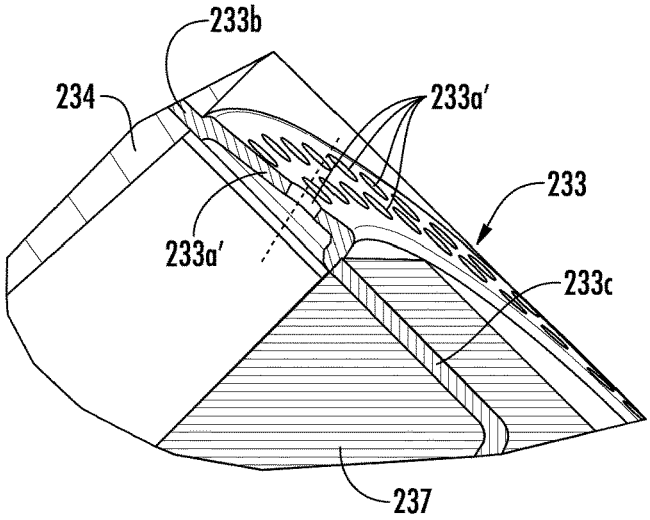
FIG. 37 is a detail view of a portion of the outlet member shown in FIG. 36.
Figure 38A:
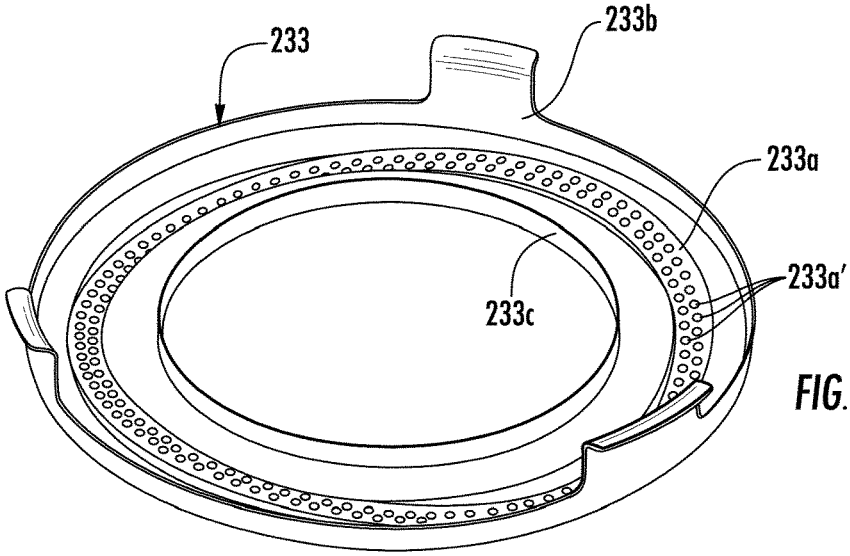
FIG. 38A is a perspective view of an outlet member according to an exemplary embodiment.
Figure 38B:
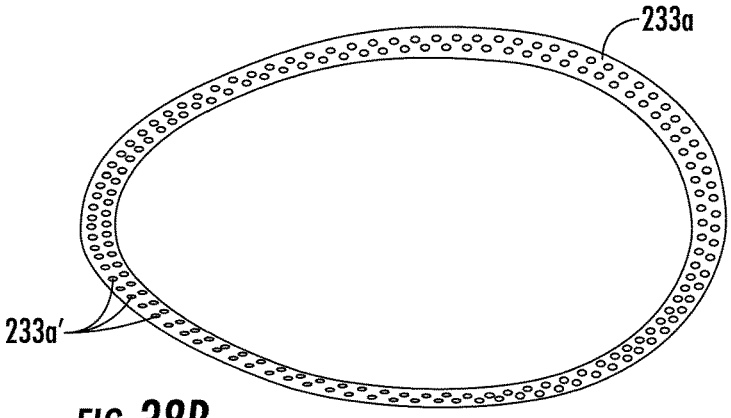
FIG. 38B is a partial perspective illustrating a spray surface of the outlet member of FIG. 38A.

The first outlet member 231 is configured to provide a first spray function. FIGS. 29-32 illustrate an exemplary embodiment of the first outlet member 231 that includes a plurality of nozzles 231*a* having an annular arrangement and configured to direct the fluid into a first spray 331 (see, for example, FIG. 39). As shown, the first outlet member 231 includes a chamber 231*b* that is defined by an outer wall 231*c* and an inner wall 231*d*. The chamber 231*b* may be fluidly connected to the valve 239 to receive the fluid therefrom. The inner wall 231*d* may define a cavity 231*e*, which may be configured to receive another element of the sprayhead 210 therein, such as the second outlet member 232. As shown in FIGS. 7, 31, and 32, the first outlet member 231 may also include one or more than one coupling features (shown in the form of tabs 231*f*) that are configured to couple the first outlet member 231 to the valve 239, such as the body 240*b*. The tabs 231*f* may be resilient in order to elastically deflect during assembly, then engage openings in the body 240 to detachably couple the first outlet member 231 and valve 239 together. According to an exemplary embodiment, the plurality of nozzles 231*a* of the first outlet member 231 are configured to provide a spray pattern having a defined shape, such as a wedge shape spray pattern (see, for example, spray 331 of FIG. 39). The defined spray pattern may have a focal length (i.e., a distance from the sprayhead 210) at which the defined shape is focused.

Figure 39:
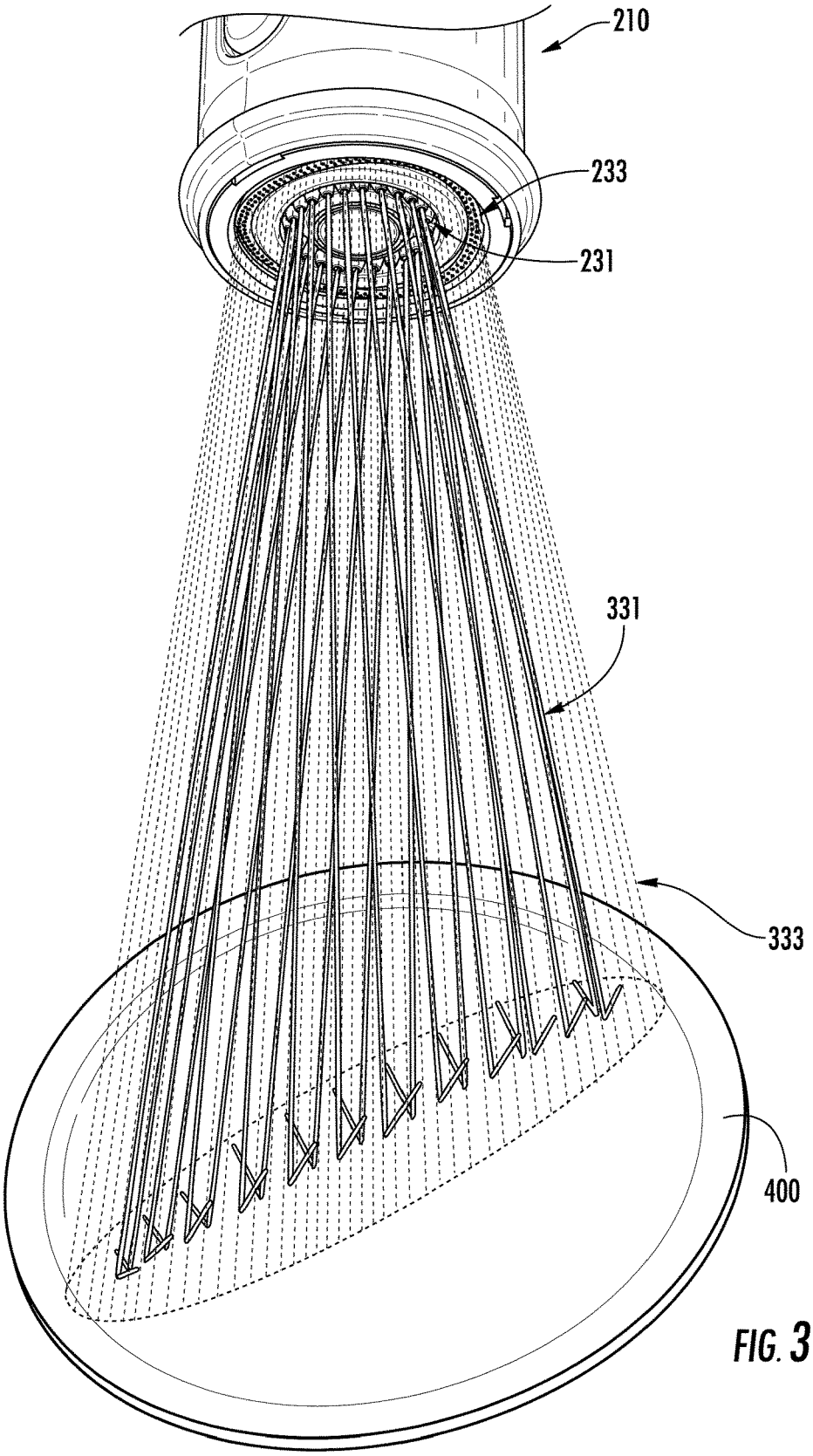
FIG. 39 is a perspective view of two spray patterns produced by a sprayhead according to an exemplary embodiment.

According to an exemplary embodiment shown in FIG. 39, the first spray 331 produced by the first plurality of nozzles 231*a* of the first outlet member 231 has a spray pattern that is substantially wedge shaped or knife shaped. The first spray 331 may have a first velocity sufficient to remove, for example, food particles from dishware or dirt/particles from food products. According to an exemplary embodiment, the velocity of the first spray 331 from the first plurality of nozzles 231*a* is about 34.0 feet/second, although the velocity of the first spray 331 may be higher or lower than about 34.0 feet/second according to other exemplary embodiments.

The second outlet member 232 is configured to provide a second spray function that is different than the first spray function of the first outlet member 231. According to an exemplary embodiment, the second outlet member 232 includes at least one nozzle 232*a* that is configured to provide an aerated stream of fluid from the sprayhead 210.

The third outlet member 233 is configured to provide a third spray function that is different than the first and second spray functions of the first and second outlet members 231 and 232. According to an exemplary embodiment, the third outlet member 233 includes a second plurality of nozzles 233*a*' that are configured to provide a fine gentle spray, such as to clean fruit or other fragile objects. For example, each of the second plurality of nozzles 233*a*' of the third outlet member 233 may provide an outward trajectory stream of fluid, so as to provide a non-intersecting shower of streams of fluid from the third outlet member.

According to the exemplary embodiment of FIG. 39, the third outlet member 233 can provide a third spray 333 that acts as a curtain or shield by surrounding the first spray 331 provided by the first outlet member 231. The third spray 333 provided by the third outlet member 233 can, advantageously, substantially impede or prevent splashing that may occur as a result of the first spray 331 contacting and deflecting from a surface of an object, such as a dish 400, food products, or the like. For example, referring to FIG. 39, when a user is operating the spray head 210 in a dual-function while cleaning the dish 400, such as in a first spray 331 and a third spray 333, a substantial portion of the first spray 331 that may deflect as a result of impacting a surface of the dish 400 will be substantially contained by the third spray 333. That is to say, the third spray 333 provided by the third outlet member 233 can contain a substantial portion of the first spray 331 that may deflect from a surface of the dish 400, so as to reduce or substantially impede splashing or deflecting outside of the boundary defined by the third spray 333.

According to an exemplary embodiment shown in FIGS. 33-39, the third outlet member 233 has a formed spray surface 233*a* that can provide a spray pattern having a cross-sectional shape that differs from a cross-sectional shape of the spray surface and/or that differs from the arrangement of the second plurality of spray nozzles 233*a*'. For example, according to an exemplary embodiment, the third outlet member 233 has a circular cross-sectional shape and an annular arrangement of second spray nozzles 233*a*', but includes a formed (e.g., stamped, bent, pressed, etc.) spray surface 233*a* having a hyperbolic-paraboloid shape. According to an exemplary embodiment, the spray surface 233*a* is formed locally along a ring of the third outlet member 233 where the second plurality of nozzles 233*a*' are disposed. The hyperbolic-paraboloid shape of the spray surface 233*a* can create a spray pattern that transitions from a circular cross-sectional shape to an elliptical cross-sectional shape (see, for example, third spray 333 of FIG. 39). The formed spray surface 233*a* is particularly advantageous in that the structure of the spray head 210 and the arrangement/positioning of the first outlet member 231 and the second outlet member 232 relative to the third outlet member 233 are not dictated by the spray pattern of the third outlet member. That is to say, the formed spray surface 233*a* allows the third outlet member 233 to have a generally circular cross-sectional shape and an annular arrangement of the second plurality of nozzles 233*a*' to surround the first outlet member 231 and the second outlet member 232, without changing the positioning/arrangement of the first plurality of nozzles 231*a* or the nozzles 232*a*. According to other exemplary embodiments, the spray surface 233*a* of the third outlet member 233 is formed to have a different shape, to thereby provide spray patterns having cross-sectional shapes such as square, triangular, or the like.

It is contemplated that any of the outlets (e.g., outlet members 231, 232, 233) may have any of the features described above, or may have any other function of water. Further, the outlets may include orifices that may or may not include a nozzle coupled to or integrally formed in each orifice. The different outlets may be configured for or used for different purposes, for example, pot filling, hand washing, dish washing, rinsing, power washing, etc., which may be performed better with different spray patterns and/or flow pressures or velocities.

FIGS. 33-39 illustrate an exemplary embodiment of a third outlet assembly that includes a third outlet member 233 having a second plurality of nozzles 233*a*' arranged in an annular manner along a spray surface 233*a*. According to the exemplary embodiment shown, the spray surface 233*a* has a circular cross-sectional shape. As shown, the spray surface 233*a* includes about 180 nozzles 233*a*', however, the number of nozzles may be tailored. According to an exemplary embodiment, the third outlet member 233 is formed from a sheet (e.g., a plate, a blank, etc.) of stainless steel having a thickness of about 0.008 inches (e.g., 0.006-0.010 inches), and the plurality of nozzles 233*a*' are etched (e.g., chemically etched, photo etched, etc.) such that each nozzle 233*a*' has a diameter of about 0.012 inches (e.g., 0.010-0.014 inches). According to another exemplary embodiment, each nozzle 233*a*' is tapered, such that the nozzle 233*a*' has an outlet that is a different size (e.g., larger, smaller) than an inlet of the nozzle 233*a*'. For example, the outlet of the nozzle 233*a*' may be about 0.012 inches, and the inlet of the nozzle 233*a*' may be about 0.016 inches (e.g., 0.014-0.018 inches).

When the second plurality of nozzles 233*a*' are formed (e.g. etched) in the spray surface 233*a*, the third outlet member 233 is preferably flat, to thereby form nozzles 233*a*' oriented perpendicular to an outer surface of the third outlet member 233. The third outlet member 233 can then be subjected to a forming operation (e.g., stamping, bending, etc.) at a localized area along the spray surface 233*a* where the second plurality of nozzles 233*a*' are disposed. According to the exemplary embodiment shown in FIGS. 37-39, the spray surface 233*a* is formed into a hyperbolic-paraboloid shape. The hyperbolic-paraboloid shape of the spray surface 233*a*, advantageously, provides a third spray 333 having a spray pattern that transitions from a circular cross-sectional shape located nearest the spray surface 233*a* to an elliptical cross-sectional shape located distal the spray surface 233*a* (see, for example, FIG. 39). However, because the hyperbolic-paraboloid shape is formed locally along the spray surface 233*a*, the third outlet member 233 includes outer and inner portions surrounding the spray surface 233*a* that are generally flat and have a circular cross-sectional shape. Thus, the shape of the mating structure of the spray head 210 (e.g., fluid chamber location, etc.), and the structures of the first outlet member 231 and the second outlet member 232 (e.g., nozzle location, spacing, etc.) are not dictated by the elliptical spray pattern provided by the third outlet member 233. According to other exemplary embodiments, the spray surface 233*a* is locally-formed into a different shape to provide a spray pattern having a cross-sectional shape, such as square, triangular, or other shapes. The third outlet member 233 may further include an outer wall 233*b* and an inner wall 233*c* that each extend from the spray surface 233*a*.

According to an exemplary embodiment shown in FIGS. 33-37, the third outlet assembly also includes an outer member 234 and a separate inner member 237 that are each formed around the third outlet member 233. The outer member 234 and the inner member 237 may be made from any suitable material, such as a plastic (e.g., resin, polymer, thermoset, thermoplastic, etc.), and may be made using any suitable method, such as injection molding. For example, the outer member 234 and the inner member 237 may be simultaneously over-molded onto the third outlet member 233 to form the third outlet assembly. According to an exemplary embodiment, during the forming of the outer member 234 and the inner member 237 (e.g., during the over-molding process), the formed hyperbolic-paraboloid shape of the spray surface 233*a* is not disturbed, because the outer member 234 is formed around the outer wall 233*b* and the inner member 237 is formed around the inner wall 233*c* of the third outlet member 233. This method of manufacturing the third outlet assembly is particularly advantageous, because the formed spray surface 233*a* can maintain its shape during the over-molding process, such that the third outlet member 233 can provide a consistent spray pattern. It is noted that the third outlet member 233 may be made from other suitable materials that are corrosion resistant and able to provide the above mentioned functionality.

The outer member 234 and the inner member 237 of the third outlet assembly may be configured to support the other outlet members. As shown in FIG. 7, the first outlet member 231 is provided in an annular cavity of the inner member 237, and the second outlet member 232 is provided in an annular cavity of the first outlet member 231. In other words, the outlet members may have a nested arrangement in the housing 215 of the sprayhead 210. The outlet members may include features (e.g., locking tabs) that are configured to secure the members to one another and or other elements of the sprayhead 210, such as the housing 215 and/or the body 240.

As shown in FIG. 1, the sprayhead 210 includes a first actuator 224 (e.g., button, switch, toggle, etc.) and a second actuator 225. The first and second actuators 224, 225 are configured to control operation of the valve 239 to change (e.g., switch) the operation of the sprayhead 210 between its one or more functions. According to an exemplary embodiment, the first actuator 224 is configured as a button configured to move between a first position (e.g., a non-depressed position, shown in FIG. 9A) and a second position (e.g., a depressed position, shown in FIG. 9B). FIG. 9B illustrates the first actuator 224 in the second position. As shown, the first actuator 224 is movable in a radial direction R that is transverse to the longitudinal direction L. When the first actuator 224 is in the first position, the valve 239 of the sprayhead 210 directs fluid (i.e., a fluid flow 332*a*) to the second outlet member 232 (see, for example, FIG. 9A). When the first actuator 224 is depressed from the first position to the second position, as illustrated in FIG. 9B, the valve 239 re-directs fluid to the first outlet member 231, and a pivotable member 236 pivots to move a slider 235 to actuate a second diverter 252, to thereby direct fluid to the third outlet member 233. That is to say, when the first actuator 224 is depressed to the second position, the first outlet member 231 and the third outlet member 233 will provide a simultaneous spray function (e.g., first spray 331 and third spray 333 of FIG. 39). The first spray function of the first outlet member 231 cannot be provided independently of the third spray function provided by the third outlet member 233, which is particularly advantageous for reasons that are discussed in the paragraphs below. However, the third outlet member 233 can provide a spray function independently of the first outlet member 231 by actuation of the second actuator 225. The details of which are discussed below.

According to an exemplary embodiment, the simultaneous functions of the first spray from the first outlet member 231 and the third spray from the third outlet member 233 is particularly advantageous, because the third spray can substantially impede or prevent splashing that may occur from the first spray contacting a surface of an object (e.g., dishware, utensils, food products, etc.). For example, referring to FIG. 39, the first outlet member 231 may provide a first spray 331 having a first velocity (e.g., about 34.0 feet/second, etc.) and the third outlet member 233 may provide a third spray 333 that surrounds the first spray 331, and has a second velocity that is lower than the first velocity of the first spray 331 (e.g., about 20 feet/second to about 28 feet/second, etc.). The higher velocity first spray 331 may splash or deflect off of a surface of an object, such as a dish 400 during, for example, cleaning of the dish 400. The lower velocity third spray 333 can act as a curtain or shield by surrounding the first spray 331, and can, advantageously, substantially contain and reduce splashing that may result from the first spray 331 impacting and deflecting from the dish 400. Thus, the pivotable member 236 allows for automatic activation of the lower velocity third spray 333 provided by the third outlet member 233 any time the higher velocity first spray 331 from the first outlet member 231 is activated. In this manner, inadvertent splashing/deflecting that may result from the first spray 331 impacting an object can be substantially reduced or prevented by the sprayhead 210.

In addition, the third spray 333 provided by the third outlet member 233 can be independently controlled via the second actuator 225. That is to say, the second actuator 225 can be actuated (e.g., pressed, etc.) by a user to independently control the movement of the second diverter 252 between its first and second positions to provide the third spray 333 from the third outlet member 233. The third spray 333 can be provided independently of the first spray 331 from the first outlet member 231.

As discussed in greater detail below, the sprayhead 210 may include a biasing member that is configured to bias the first actuator 224 (e.g., such as through a diverter). For example, the biasing member may bias the first actuator 224 in a direction from the second position to the first position. This arrangement may advantageously configure the first actuator 224 as a momentary switch, where the button must be retained in the depressed position (e.g., the second position) in order to maintain the alternative spray pattern (e.g., the first spray pattern). Once the pressure depressing the first actuator 224 is released, the biasing force will move the first actuator 224 to the non-depressed position, and the sprayhead 210 will change function (e.g., away from the first and third spray patterns).

Figure 8:
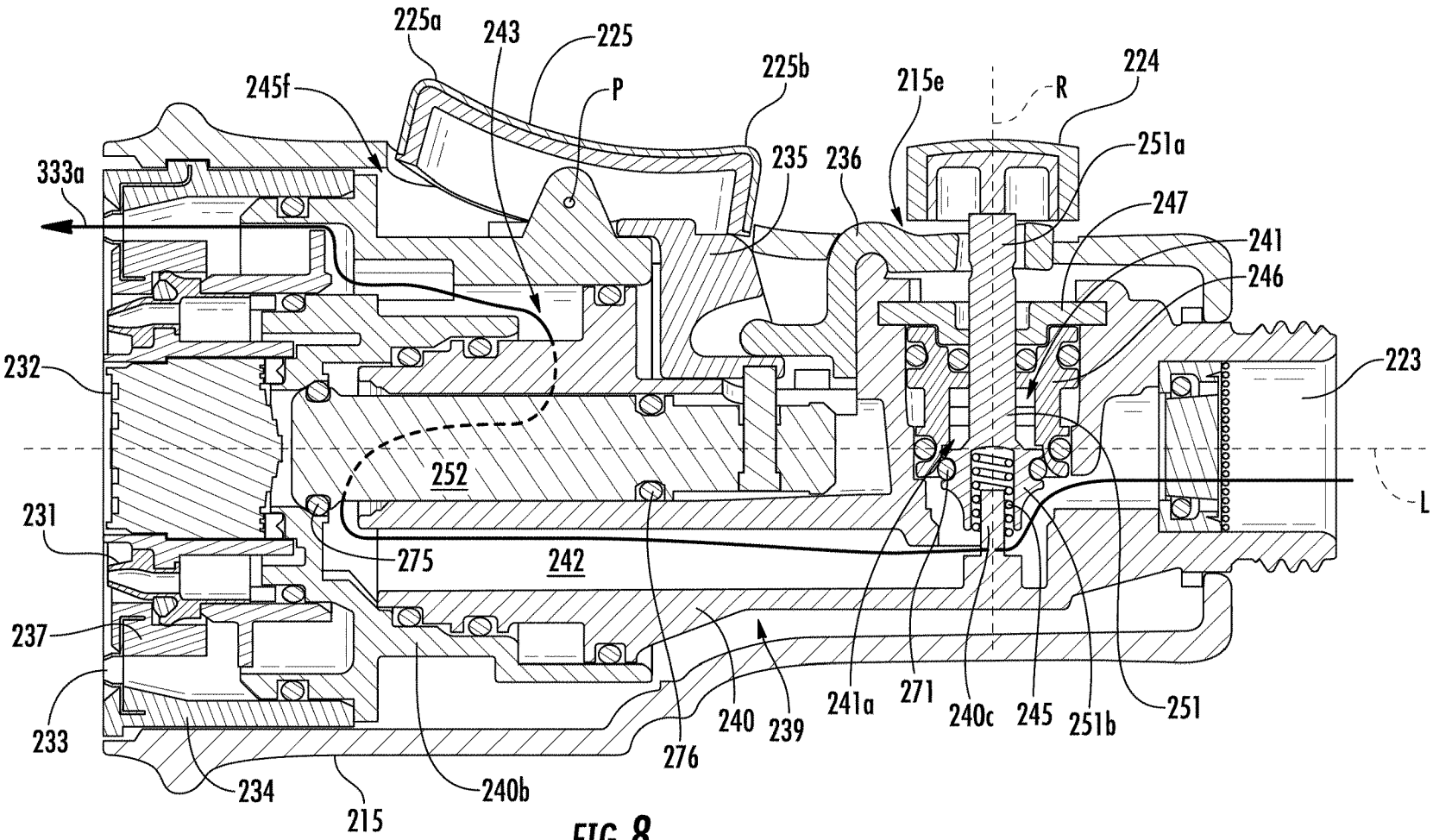
FIG. 8 is a side cross-sectional view of the sprayhead through line 8-8 of FIG. 6.

The second actuator 225 may be configured to move between a first position, in which the fluid is directed to either the second outlet member 232 or the third outlet member 233, and a second position, in which the fluid is directed to the other outlet member. According to an exemplary embodiment, the second actuator 225 is configured as a toggle that pivots between a first position (e.g., a forward position) and a second position (e.g., a rearward position). The forward position of the second actuator 225 may correspond to when a front portion 225*a* of the second actuator 225 is depressed toward the sprayer (e.g., toward the longitudinal axis L) and when a rear portion 225*b* of the second actuator 225 is extended away from the sprayer or the longitudinal axis L. The rearward position of the second actuator 225 may correspond to when the rear portion 225*b* is depressed toward the sprayer or the longitudinal axis L and the front portion 225*a* is extended away from the sprayer or the longitudinal axis L. FIG. 8 illustrates the second actuator 225 in the rearward position. The second actuator 225 may be pivotally coupled to the valve 239 and/or to another element of the sprayhead, such as a housing. As shown, the second actuator 225 is pivotally coupled to a pivot "P" of the body 240.

According to an exemplary embodiment, when the second actuator 225 is in the first position, fluid is directed to the second outlet member 232 (e.g., a fluid flow 332*a* shown in FIG. 9A), and when the second actuator 225 is in the second position, fluid is directed to the third outlet member 233 (e.g., a fluid flow 333*a* shown in FIGS. 8 and 9B). Thus, a user of the sprayhead 210 may switch between the second and third spray functions by moving (e.g., toggling) the second actuator 225 between its first and second positions. The second actuator 225 functions independently of the first actuator 224. That is to say, the second actuator 225 can independently control movement of the second diverter 252 to direct fluid to the second outlet member 232 or the third outlet member 233.

The sprayhead 210 may optionally include a housing 215 (e.g., a casing, etc.) that is configured to house one or more elements of the sprayhead 210. As shown in FIG. 7, the housing 215 includes an outer wall having a first portion 215*a* and a second portion 215*b*, which house and surround at least a portion of the valve 239. In other words, the outer wall of the housing 215 defines a cavity (e.g., chamber, etc.) for receiving at least a portion of the valve 239 therein. The outer wall may include an opening therein. As shown, the outer wall of the housing 215 includes a first opening 215*c* disposed at a first end (e.g., an inlet end) of the housing 215 adjacent to the first portion 215*a* and also includes a second opening 215*d* disposed at a second end (e.g., an outlet end) of the housing 215 adjacent to the second portion 215*b*. A portion of the sprayhead 210, such as the connector 222 and/or the valve 239, is configured to extend through the first opening 215*c*. The one or more outlet members may be disposed in the second opening 215*d*. As shown, the first outlet member 231, the second outlet member 232, and the third outlet member 233 are disposed in the second opening 215*d* of the housing 215, such that the fluid directed from the outlet members are discharged from the second end of the housing 215 having the second opening 215*d*.

The housing 215 may include one or more than one feature configured to couple and/or secure another element of the sprayhead 210 to the housing. For example, the housing 215 may include a feature, such as a twist-and-lock feature, that the third outlet assembly detachably (e.g., removably, selectively, etc.) couples thereto. As shown in the exemplary embodiment of FIG. 33, the outer member 234 of the third outlet assembly includes a plurality of protrusions 234*a* for engaging with corresponding mating features of the outer wall (e.g., second portion 215*b*) of the housing 215 to detachably (e.g., removably, etc.) couple the third outlet assembly to the housing 215. According to an exemplary embodiment, one or more of the protrusions 234*a* has a size that is different from the one or more of the other protrusions 234*a* to provide a locating function or poke-a-yoke function for orientating/positioning the third outlet assembly along an angular direction relative to the housing 215. In this way, a user can easily and properly install the third outlet assembly to the sprayhead 210.

According to an exemplary embodiment, the protrusions 234*a* can be selectively engaged with and selectively disengaged from the mating features on the housing 215 in a twist-and-lock configuration. That is to say, a user can couple the third outlet assembly to the housing 215 by inserting the third outlet assembly into the housing 215 and rotating the third outlet assembly about the longitudinal axis L an angular distance of less than about 90 degrees (e.g., 15 degrees, etc.) until the protrusions 234*a* engage with the mating features of the housing 215. Likewise, the user can remove the third outlet assembly from the housing 215 by rotating the third outlet assembly in an opposite direction until the protrusions 234*a* are disengaged from the mating features of the housing 215. This arrangement, advantageously, allows the third outlet assembly (e.g., along with the third outlet member 233) to be easily removed from the housing 215, such as for cleaning, maintenance, or repair. This is particularly advantageous for the embodiment of the third outlet member 233 having 0.012 inches diameter nozzles 233*a*', since the nozzles may become plugged with debris due to their relative small size, which provides a more gentle, curtain spray. Also, for example, the housing 215 may include a feature that facilitates coupling of the valve 239 to the housing 215.

Figure 2:
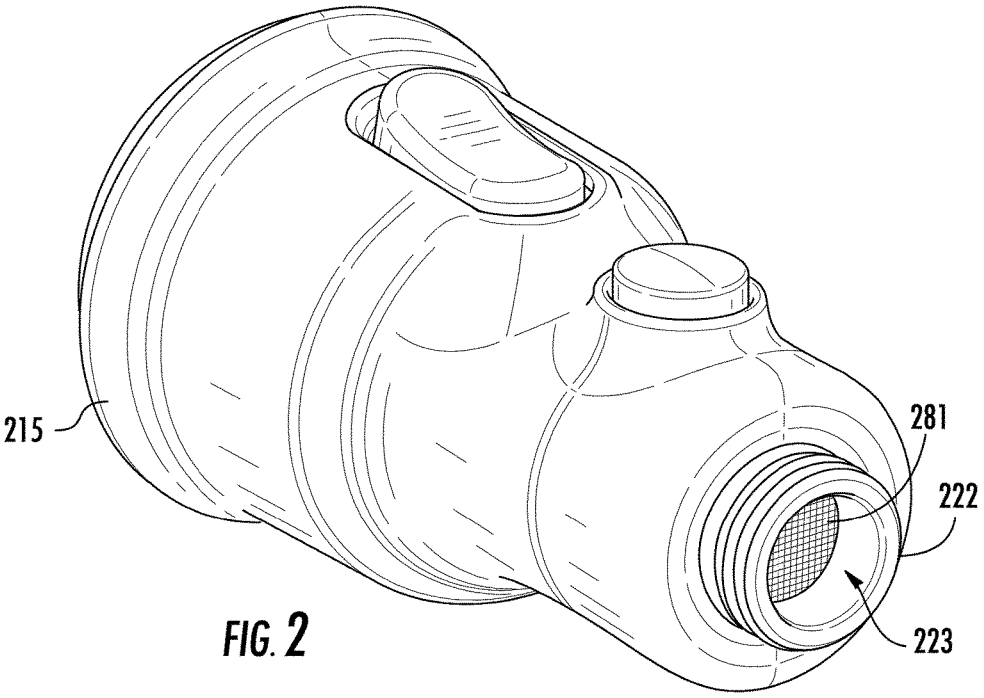
FIG. 2 is a rear perspective view of the sprayhead of FIG. 1.
Figure 3A:
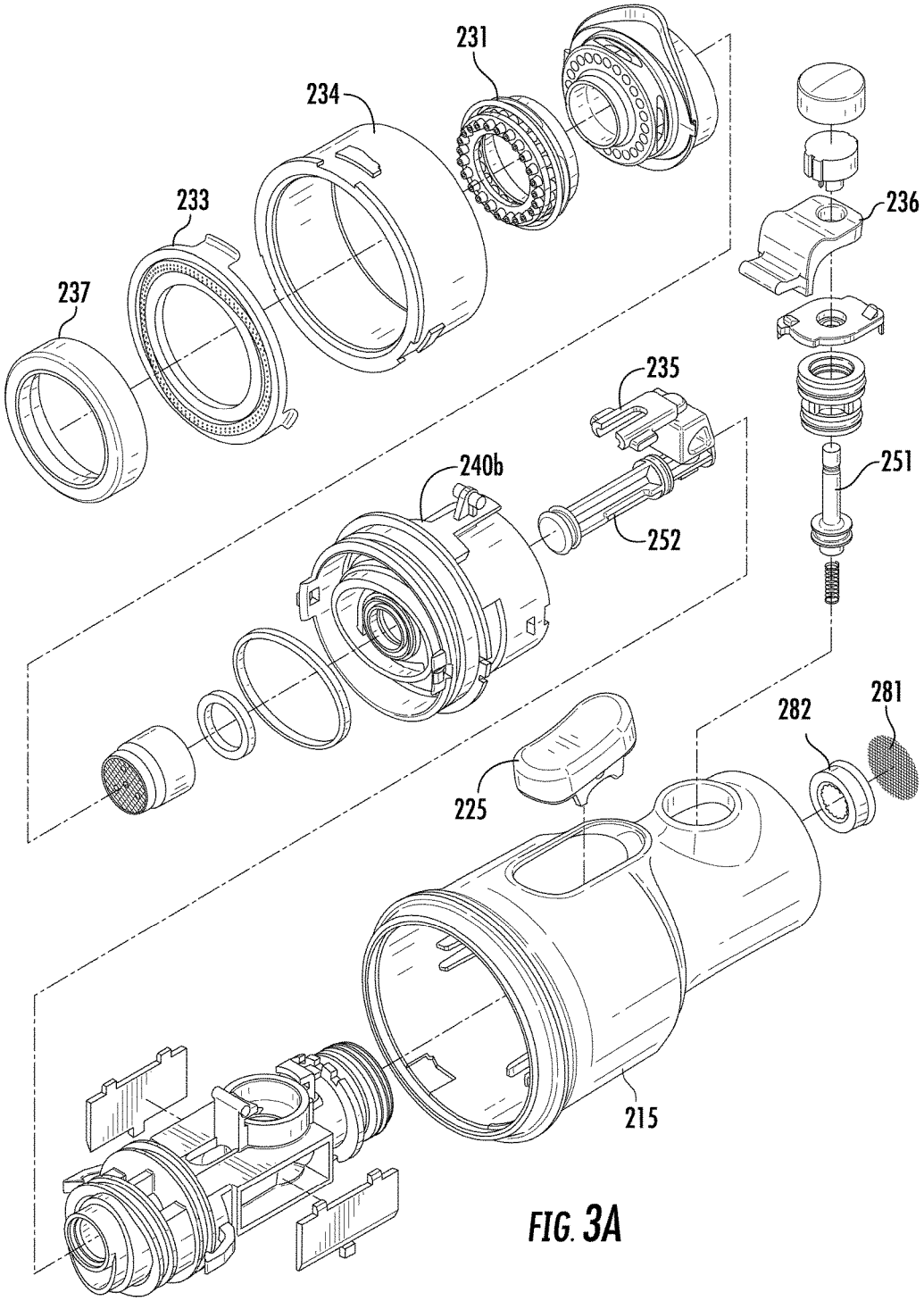
FIG. 3A is an exploded perspective view of the sprayhead of FIG. 1.
Figure 3B:
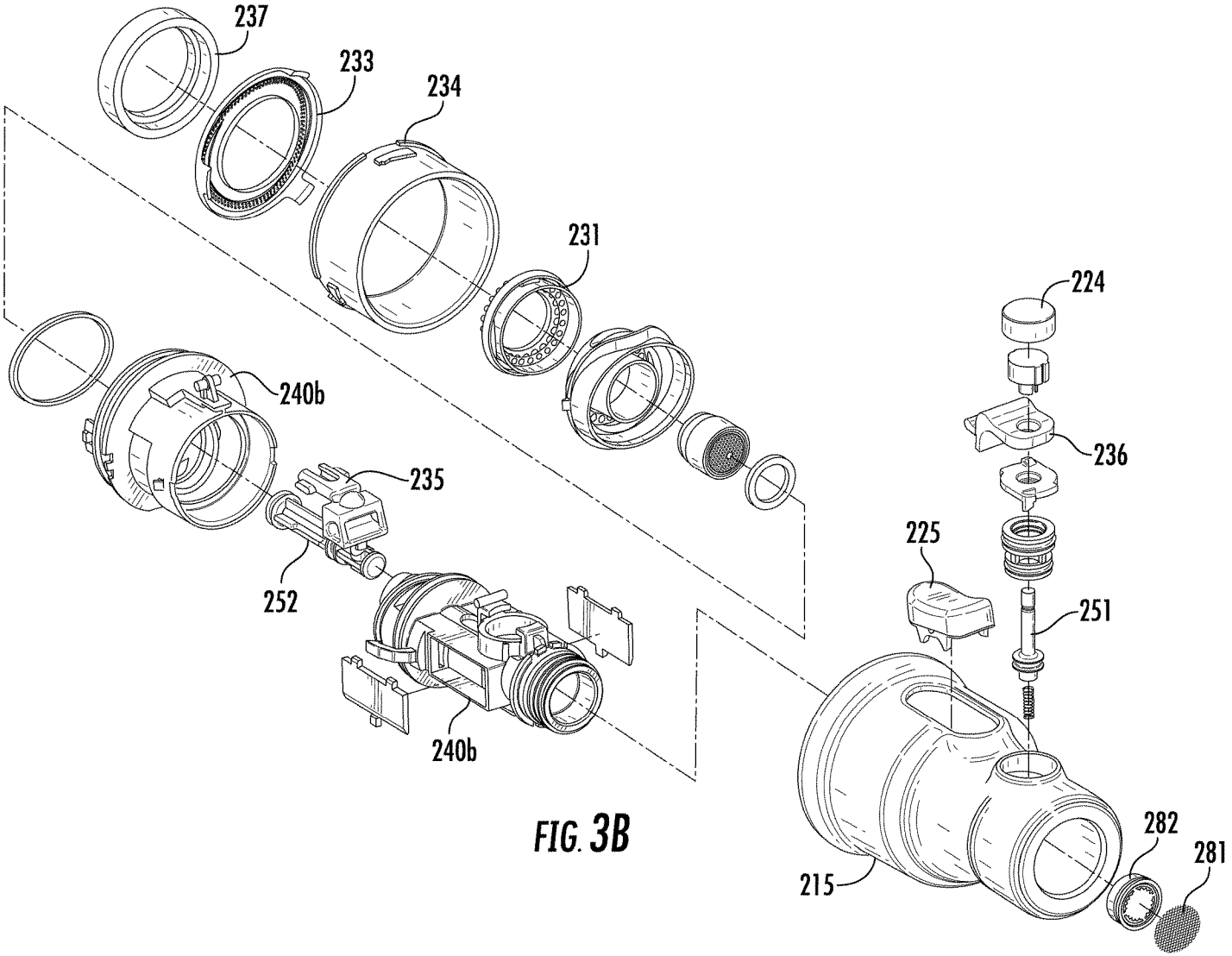
FIG. 3B is another exploded perspective view of the sprayhead of FIG. 1.
Figure 4:
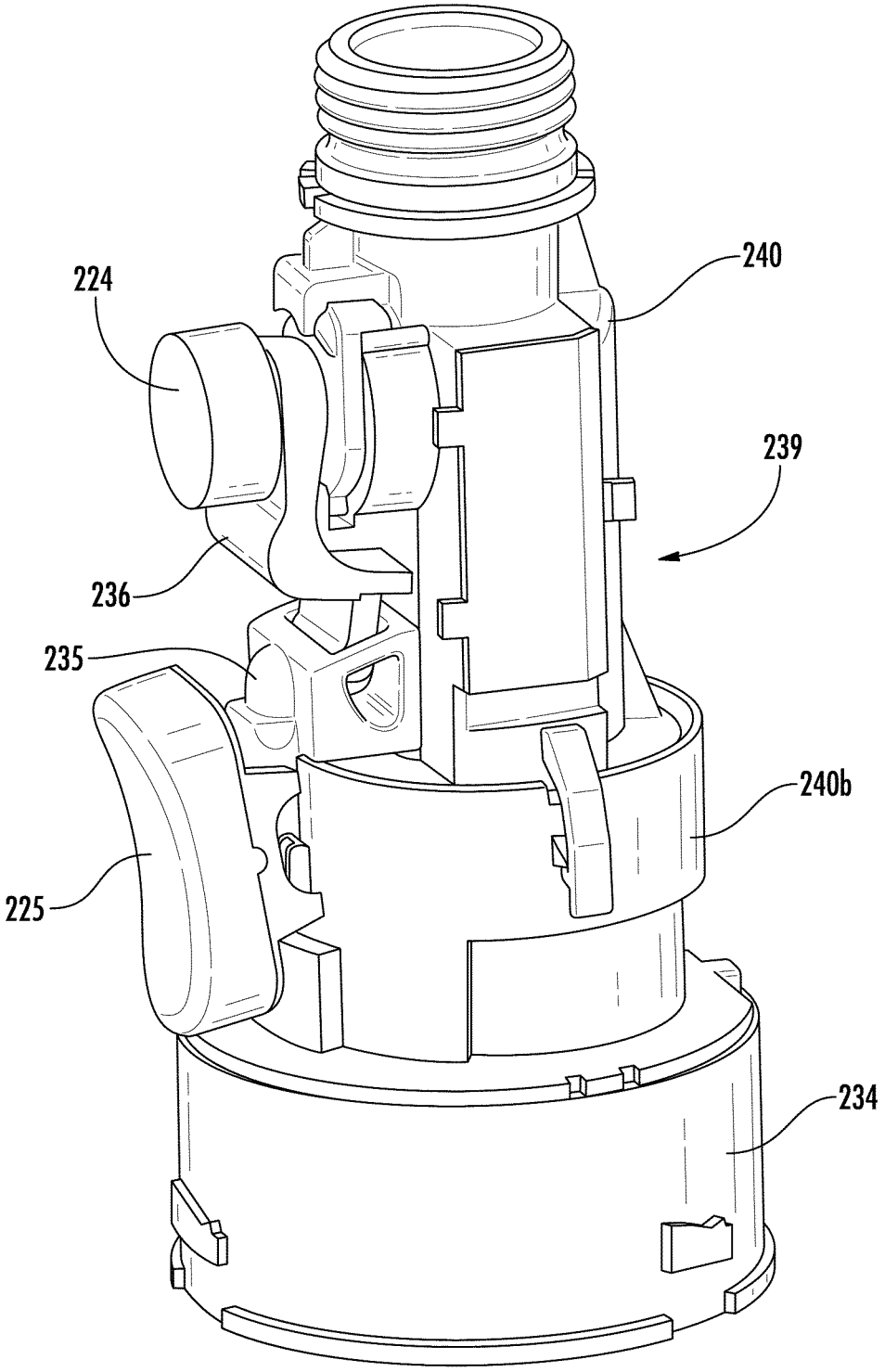
FIG. 4 is a perspective view of the sprayhead of FIG. 1, without a housing.
Figure 5:
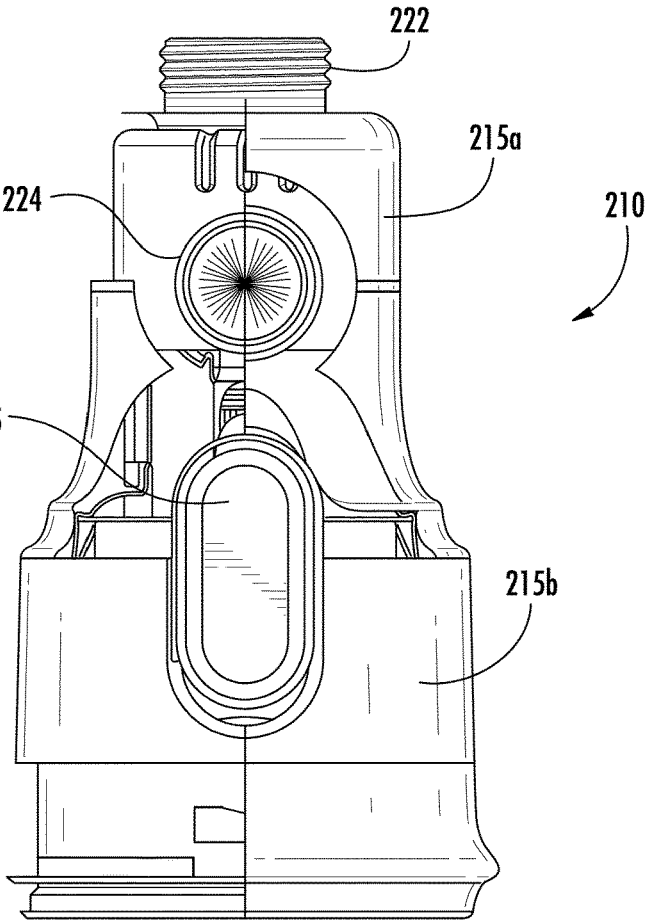
FIG. 5 is a top view of the sprayhead of FIG. 1, with select portions of the housing removed for clarity.

The housing 215 may further include one or more additional openings, such as, for example, to receive the one or more actuators for controlling operation of the sprayhead 210. As shown in FIGS. 1-3, the housing 215 includes a third opening 215*e* that is configured to receive the first actuator 224 and a fourth opening 215*f* that is configured to receive the second actuator 225. The third opening 215*e* may have a generally circular cross-sectional shape to define a cylindrical bore in the housing 215 to receive the first actuator 224, or may have any suitable shape that is tailored to the shape of the first actuator 224. The fourth opening 215*f* may have a generally elongated (e.g., elliptical, slotted, etc.) cross-sectional shape to define a bore in the housing 215 that has a corresponding shape as the second actuator 225, or may have any suitable shape that is tailored to the shape of the second actuator 225.

Figure 20:
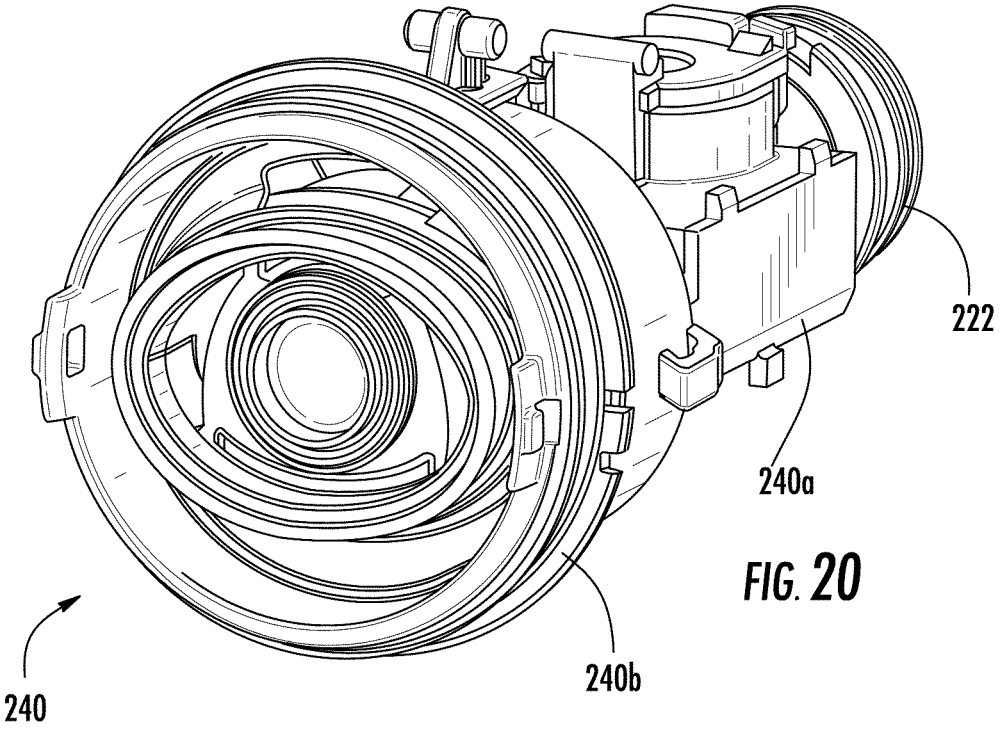
FIG. 20 is a perspective view of an exemplary embodiment of a body of a sprayhead.
Figure 21:
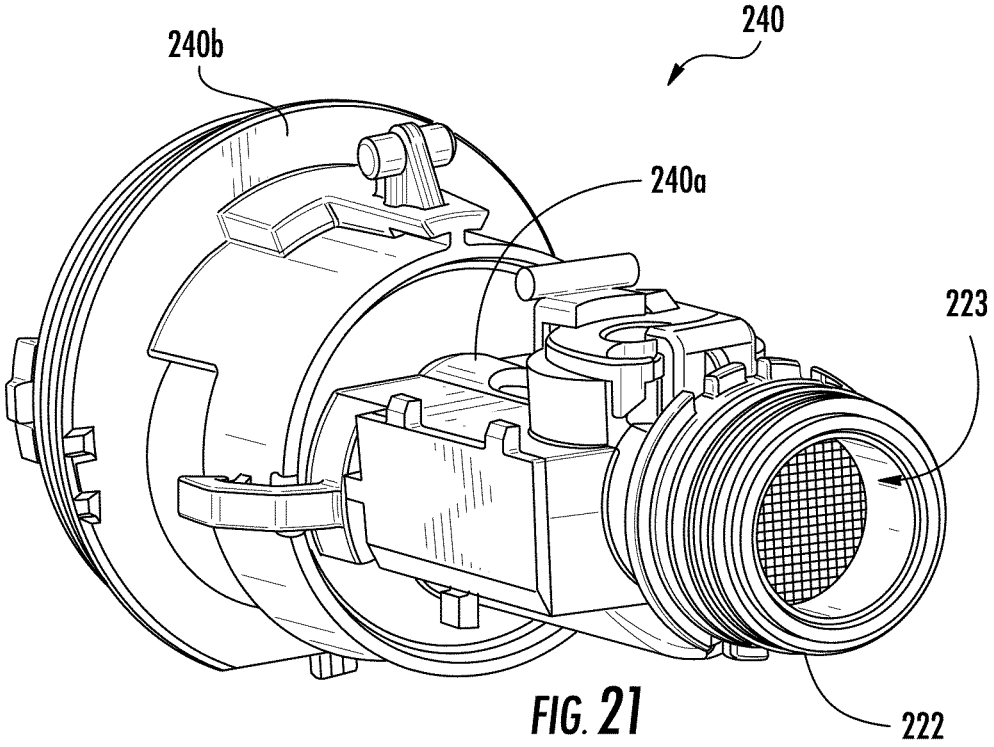
FIG. 21 is another perspective view of the body of FIG. 20.

As shown in FIGS. 3, 7, and 8, the valve 239 (e.g., fluid control valve) includes a body 240 (e.g., a valve body). FIGS. 20 and 21 illustrate an exemplary embodiment of the body 240. The body 240 includes an inlet that is configured to receive a supply of fluid. According to one example, the inlet of the body 240 is the inlet 223 of the sprayhead 210. For this example, the connector 222 may optionally be integrally formed with the body 240. According to another example, the inlet of the body 240 is separately formed from the inlet 223 (and/or the connector 222) of the sprayhead 210. For this example, the inlet of the body 240 may be in fluid communication with (e.g., fluidly connected to) the inlet 223.

The valve 239 may also include one or more than one chamber that is configured to receive the fluid. As shown in FIGS. 7 and 8, the body 240 of the valve 239 includes a first chamber 241, a second chamber 242, and a third chamber 243, where each chamber is configured to selectively receive the fluid depending on the mode of operation of the sprayhead 210 (e.g., the arrangement of the valve 239). The one or more chambers may be defined by the body 240, either alone or in combination with other elements of the sprayhead 210.

The body 240 may include one or more portions. As shown in FIGS. 20 and 21, the body 240 includes a first portion 240*a* and a second portion 240*b*, which may be integrally formed together or formed separately then coupled together. As shown, the first portion 240*a* is the inlet end of the body 240 and the second portion 240*b* is the outlet end of the body 240.

Figure 22:
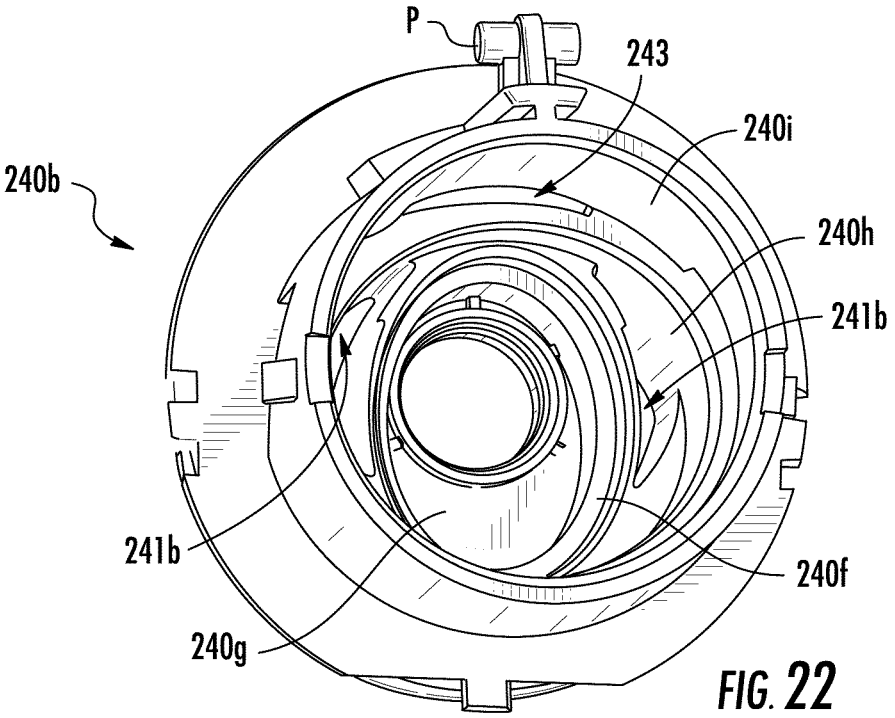
FIG. 22 is a rear projection view of a portion of the body of FIG. 20.
Figure 23:
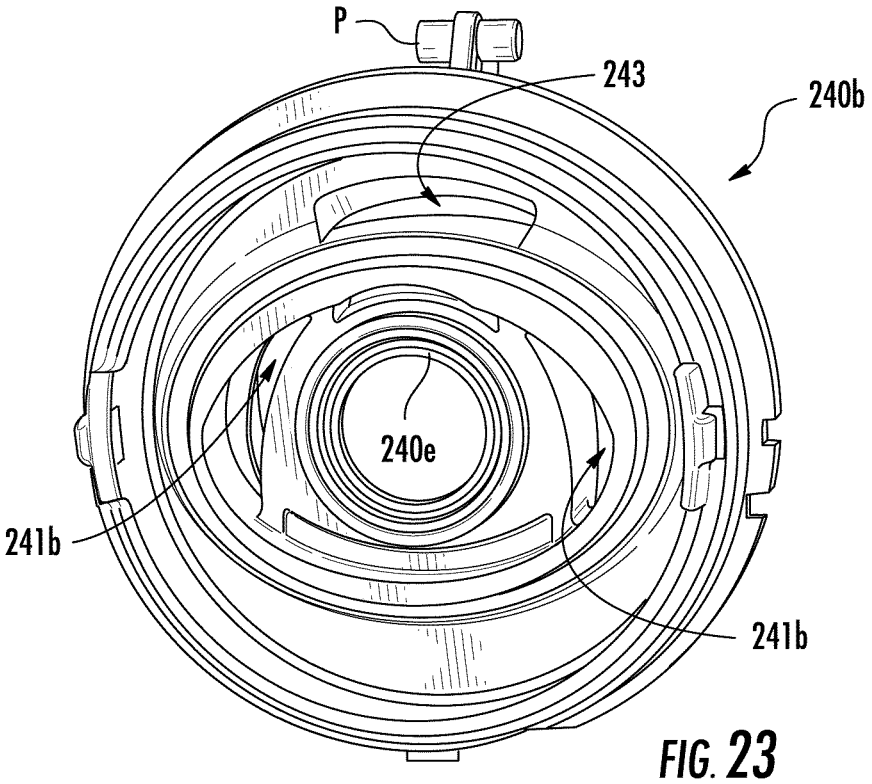
FIG. 23 is a front projection view of the portion of FIG. 20.

FIGS. 22 and 23 illustrate an exemplary embodiment of a second portion 240*b* of the body 240. The second portion 240*b* may be configured to include one or more circular, elliptical, and/or other suitably shaped members (e.g., sections, walls, etc.) to help define the one or more chambers of the valve 239. As shown, the second portion 240*b* includes a circular shaped inlet 240*e*, a first elliptical section 240*f* that is provided around the inlet 240*e* and extends from a base 240*g* away from the inlet 240*e*, a second elliptical section 240*h* provided around and extending from the first elliptical section 240*f* away from the inlet 240*e*, and a first circular section 240*i* provided around and extending from the second elliptical section 240*h* away from the inlet 240*e*. The first elliptical section 240*f* may have a major axis that extends in the radial direction R and a minor axis that extends in a second direction that is transverse to the radial direction. The first elliptical section 240*f* may help define the second chamber 242, such as together with the base 240*e* and the first portion 240*a*. The second elliptical section 240*h* may have a major axis that extends in the second (transverse) direction of the minor axis of the first elliptical section 240*f* and a minor axis that extends in the radial direction R. The second elliptical section 240*h* may help define the second portion 241*b* of the first chamber 241, either alone or in combination with the first elliptical section 240*f*. The first circular section 240*i* may have a first axis that extends in the radial direction R and a second axis that extends in a second (transverse) direction. The first circular section 240*i* may help define the third chamber 243, either alone or in combination with the second elliptical section 240*h*. According to the example shown, the second portion 240*b* includes the pivot P, about which the second actuator 225 is configured to pivot.

FIGS. 24-28 illustrate an exemplary embodiment of the first portion 240*a* of the body 240. The first portion 240*a* may be configured to include one or more circular, elliptical, and/or other suitably shaped members (e.g., sections, walls, etc.) to help define the one or more chambers of the valve 239. For example, the first portion 240*a* may include members that help define the inlet 223, the connector 222, the first chamber 241 (e.g., the first portion 241*a*, the second portion 241*b*), the second chamber 242, and/or the third chamber 243. As shown, the first portion 240*a* includes a second circular section 240*j* that helps define the third chamber 243, a first elliptical section 240*k* that helps define the second chamber 242, and a second elliptical section 240*m* that helps define the second portion 241*b* of the first chamber 241. For example, the second chamber 242 may be defined by the first elliptical section 240*k* in combination with the second circular section 240*j*. Also, for example, each second portion 241*b* may be defined by the second elliptical section 240*m* in combination with the first elliptical section 240*k* and/or the second circular section 240*j*.

Figure 24:
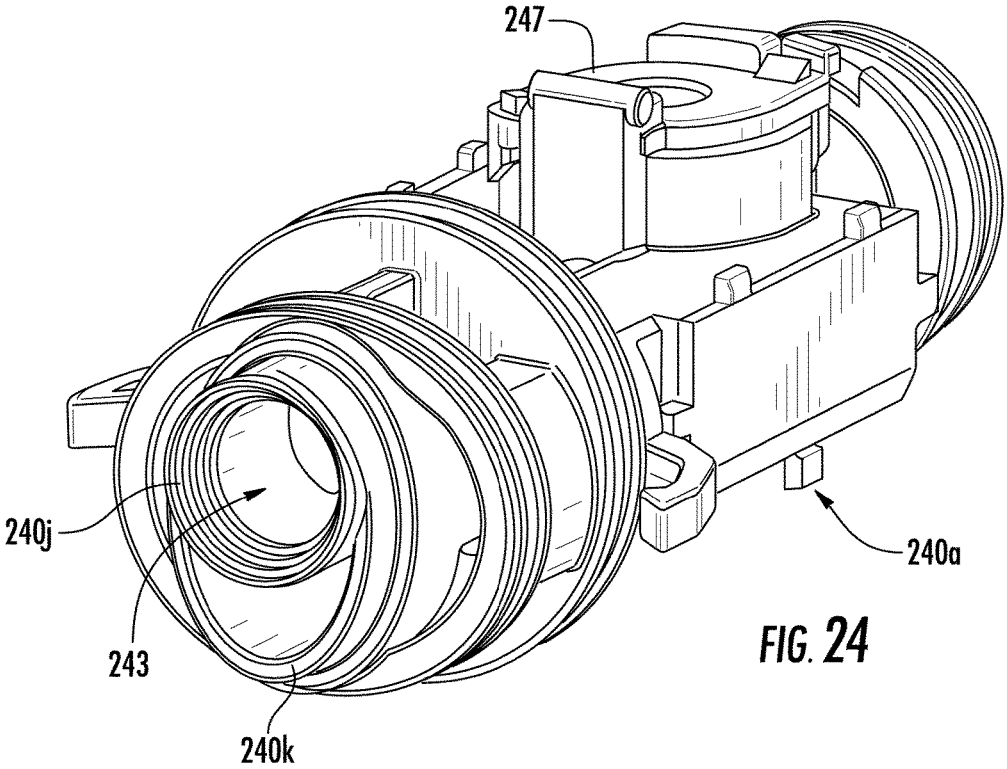
FIG. 24 is a perspective view of a portion of a body of a sprayhead.
Figure 25:
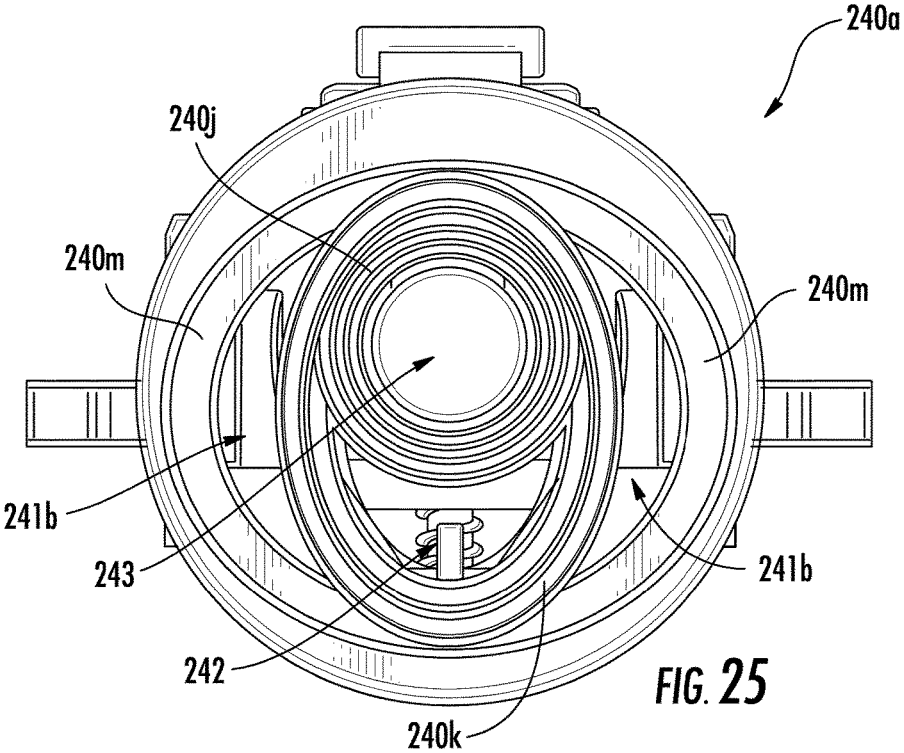
FIG. 25 is a front view of the portion of the body of the sprayhead of FIG. 24.
Figure 26:
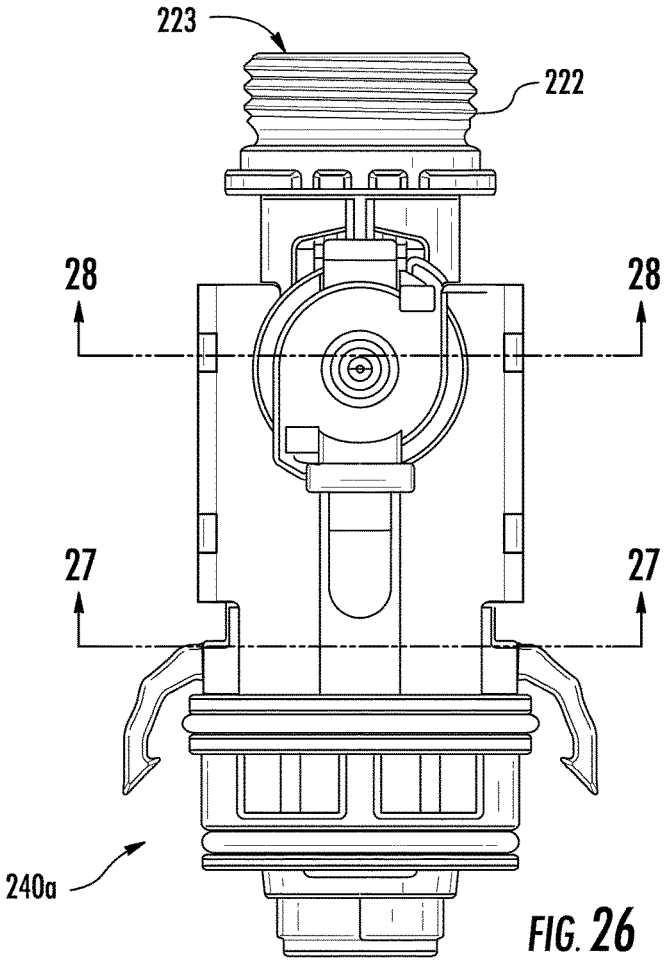
FIG. 26 is a top view of the portion of the body of the sprayhead of FIG. 24.
Figure 27:
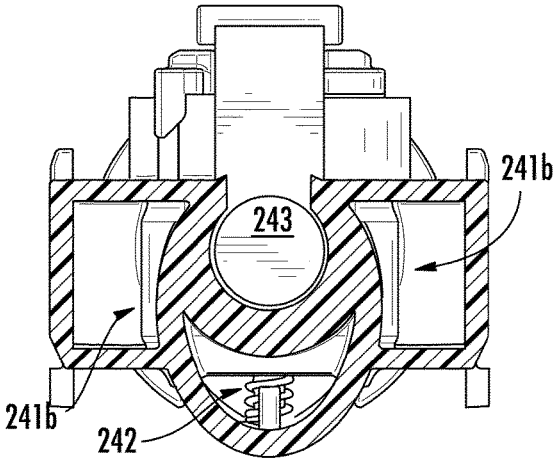
FIG. 27 is a front cross-sectional view of the sprayhead through line 27-27 of FIG. 26.
Figure 28:
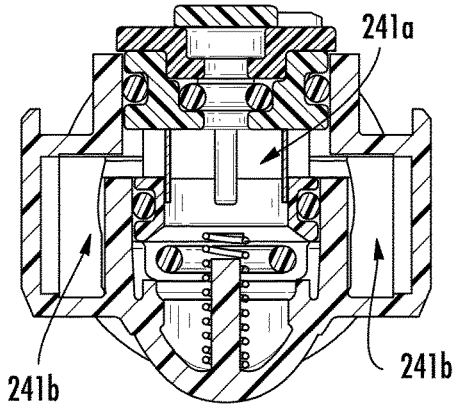
FIG. 28 is another front cross-sectional view of the sprayhead through line 28-28 of FIG. 26.
Figure 29:
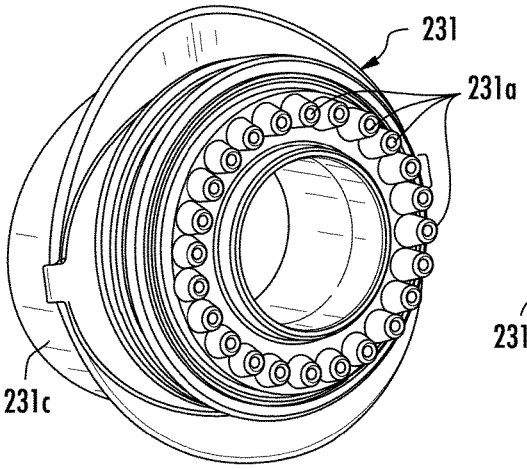
FIG. 29 is a front perspective view of an exemplary embodiment of an outlet member of a sprayhead.
Figure 30:
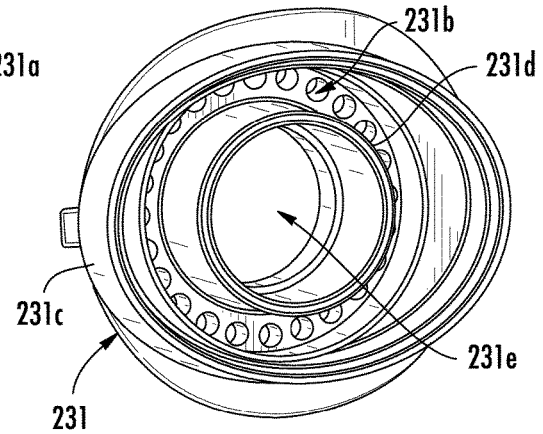
FIG. 30 is a rear perspective view of the outlet member of FIG. 29.

The first elliptical section 240*k* may have a major axis that extends in the radial direction R and a minor axis that extends in a second transverse direction. The second circular section 240*j* may be contained within, for example, the first elliptical section 240*k*, such that a portion or all of the second circular section 240*j* is provided within the first elliptical section 240*k*, as shown in FIGS. 24 and 25. According to an exemplary embodiment, the first elliptical section 240*k* and the second circular section 240*j* are at least partially tangent to one another. The second elliptical section 240*m* may have a major axis that extends in the second transverse direction and a minor axis that extends in the radial direction R. The plurality of elliptical sections of the body 240 may advantageously allow for the body 240 to include multiple chambers, which supply fluid to multiple outlets, in a relative small size (e.g., cross-section). Thus, the sprayhead 210 can provide multiple spray functions and still have a relatively compact size.

The valve 239 may also include one or more than one diverter (e.g., divert piston, piston, valve stem, etc.). As shown in FIGS. 7 and 8, the valve 239 includes a first diverter 251 and a second diverter 252, where the first and second diverters 251, 252 are movable within the body 240 to control the fluid flow between the first, second, and third chambers 241, 242, 243. According to an exemplary embodiment, the second diverter 252 is oriented transverse relative to the first diverter 251.

Figure 9A:
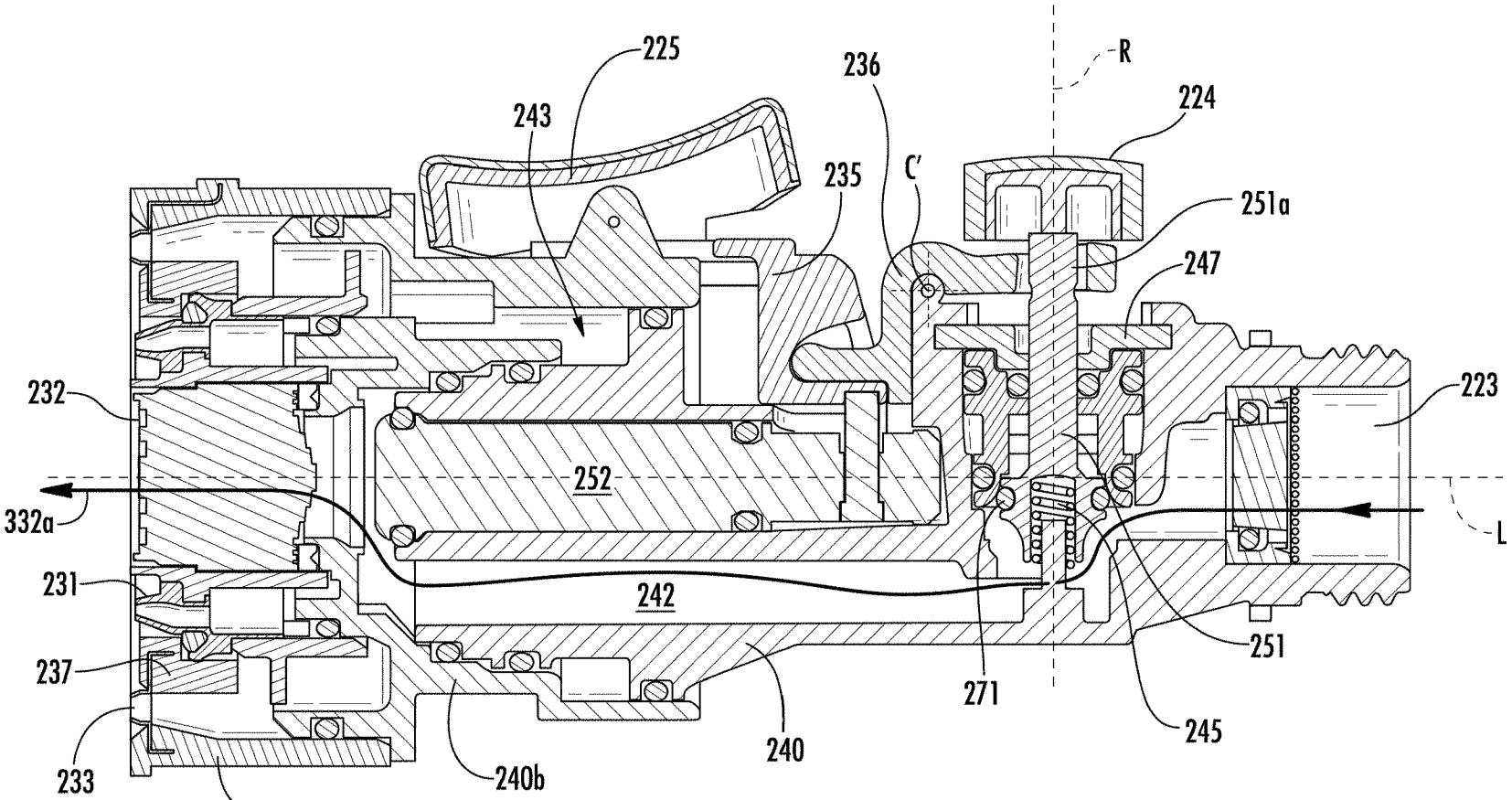
FIG. 9A is a side cross-sectional view of the sprayhead of FIG. 6 shown in a first functional state.
Figure 9B:
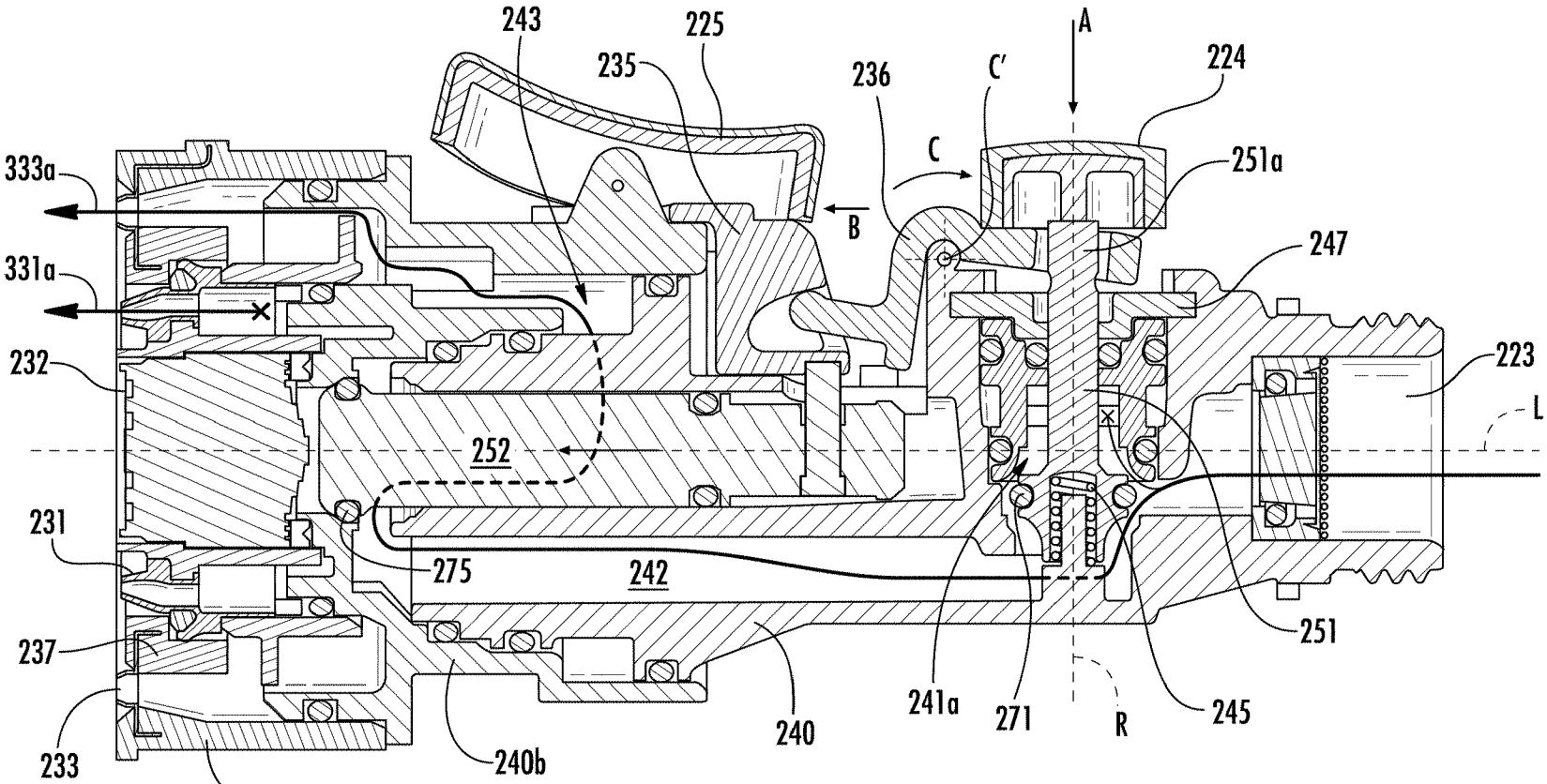
FIG. 9B is a side cross-sectional view of the sprayhead of FIG. 6 shown in a second functional state.
Figure 10:
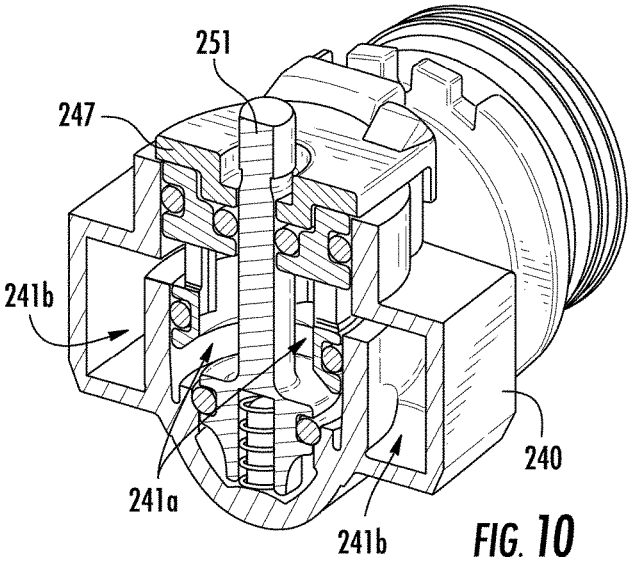
FIG. 10 is a perspective cross-sectional view of a portion of the sprayhead of FIG. 1.

According to an exemplary embodiment shown in FIGS. 9A-9B, the first diverter 251 is movable between a first position (e.g., upward position, non-depressed position) and a second position (e.g., downward position, depressed position). FIG. 9B illustrates the first diverter 251 in the second position. When the first diverter 251 is in the second position, the first chamber 241 is fluidly connected to the inlet 223 and the second chamber 242 is fluidly connected to the inlet 223, such that the fluid flow is directed from the inlet 223 to the first chamber 241 and to the second chamber 242 to provide a first spray 331 and a third spray 333. When the first diverter 251 is in the first position, as shown in FIG. 9A, the second chamber 242 is fluidly connected to the inlet 223 and the first chamber 241 is fluidly disconnected from the inlet 223, such that a second fluid flow 332*a* is directed from the inlet 223 to the second chamber 242 to provide a second spray function. Accordingly, no fluid is directed into the first chamber 241 when the first diverter 251 is in the first position.

As shown in FIGS. 9A-9B, the first actuator

224 is configured to move (e.g., slide, translate, etc.) the first diverter 251 along a radial direction R between its first and second positions, and to simultaneously move the second diverter 252 along a longitudinal direction L between its first and second positions, to thereby control fluid flow to both the first outlet member 231 and the third outlet member 233 when actuated (e.g., depressed). A portion of the first diverter 251 may be coupled directly (or indirectly through another element of the sprayhead 210) to the first actuator 224, such that movement of the first actuator 224 results in a corresponding movement of the first diverter 251. For example, a first end 251*a* of the first diverter 251 may be coupled to the first actuator 224. The first actuator 224 may move relative to, for example, the housing 215. Additionally, the first actuator 224 may be coupled directly or indirectly through another element, such as pivotable member 236, to the second diverter 252, such that movement of the first actuator 224 also results in a corresponding movement of the second diverter 252. That is to say, the first actuator 224 may be operatively coupled to both the first diverter 251 and to the second diverter 252 to control a corresponding movement thereof. According to an exemplary embodiment, the second diverter 252 may be controlled independently of the first diverter 251 through, for example, the second actuator 225, the details of which are discussed in the paragraphs that follow.

FIGS. 44-47 illustrate an exemplary embodiment of the first diverter 251. The first diverter 251 includes the first end 251*a*, a second end 251*b*, and a sealing portion 251*c*, which may be provided between the first and second ends 251*a*, 251*b*. As shown in FIG. 8, the sealing portion 251*c* is configured to provide a seal between the first diverter 251 and a portion of the valve 239 (e.g., a portion of the body 240) to prevent the fluid from passing beyond the seal. For example, the sealing portion 251*c* may seal-off the first chamber 241 to prevent fluid from passing from the inlet 223 to the first chamber 241 when the first diverter 251 is configured in the first position.

Figure 46:
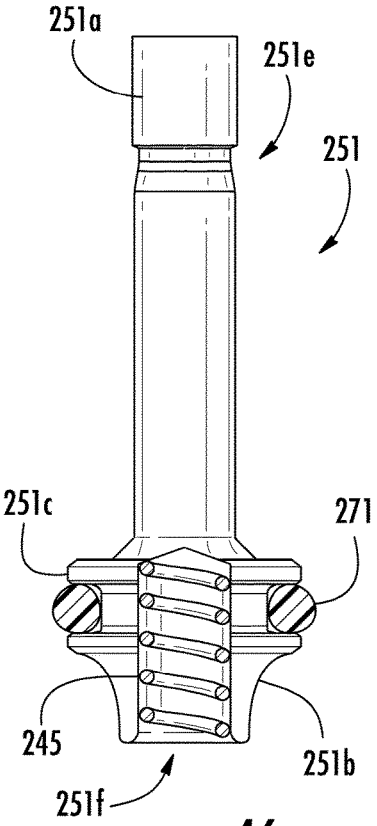
FIG. 46 is a partial side cross-sectional view of the diverter assembly of FIG. 44.
Figure 47:
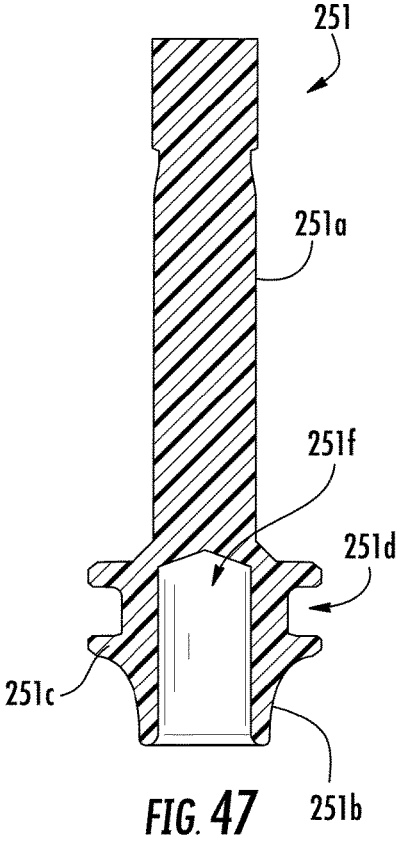
FIG. 47 is a side cross-sectional view of an exemplary embodiment of a diverter of the diverter assembly of FIG. 44.
Figure 48:
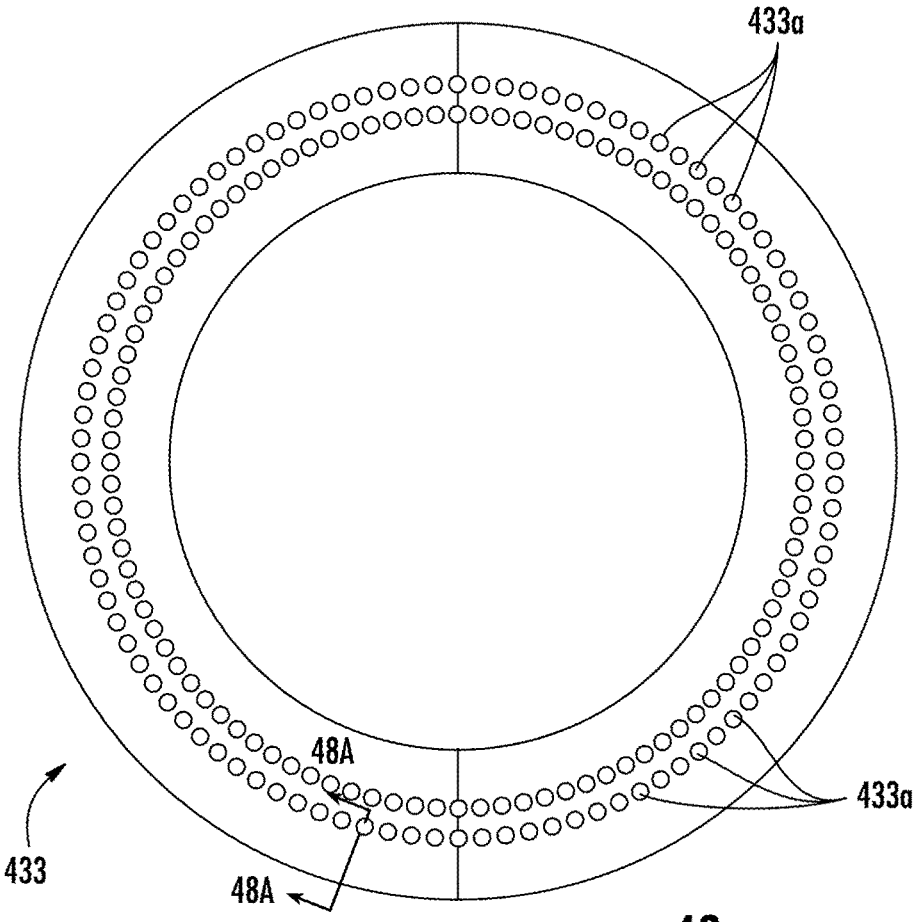
FIG. 48 is a front view of another exemplary embodiment of an outlet member of a sprayhead.
Figure 48A:
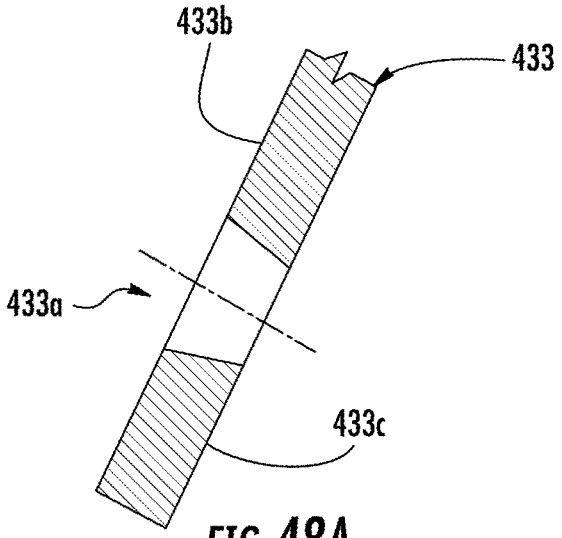
FIG. 48A is a cross-sectional view of the outlet member of FIG. 48 taken along line 48A of FIG. 48.

As shown in FIGS. 44-47, the first diverter 251 is configured generally as a piston (e.g., has a piston shape). The first end 251*a* may have a generally cylindrical shape, which may include a feature, such as an undercut section 251*e* (e.g., recess, channel, etc.) that is configured to receive a portion of the first actuator 224 to couple the first diverter 251 and first actuator 224 together. The first end 251*a* may also receive a portion of the pivotable member 236 around the first end 251*a*. The first actuator 224 may include a flexible detent member that expands when moving over the non-undercut portion of the first end 251*a*, then snaps into a mechanical locking arrangement with the undercut when the detent member engages the undercut. The second end 251*b* may have a generally cylindrical shape, conical shape, or any suitable shape. The sealing portion 251*c* may have a generally cylindrical shape that is disposed closer to the second end 251*b*. However, it is noted that the shape of the first diverter 251, as well as the location of the sealing portion 251*c*, can be tailored to the geometry of the valve 239 (e.g., the body 240). The sealing portion 251*c* may include a raised (e.g., an outwardly extending) portion relative to the second end 251*b* (and/or the first end 251*a*). As shown in FIGS. 46 and 47, the sealing portion 251*c* is configured as a shoulder extending away from the second end 251*b*. The sealing portion 251*c* may optionally include a channel 251*d* (e.g., recessed portion) configured to receive a sealing member (e.g., a seal, an o-ring, etc.). As shown, the channel 251*d* is recessed into the shoulder of the sealing portion 251*c*, such that the sealing portion 251*c* has a generally C-shaped cross-section to receive the sealing member 271 in the form of an o-ring in the channel 251*d*. For the embodiment including the sealing member 271, the sealing member 271 may alone, or in cooperation with the sealing portion 251*c*, fluidly disconnect the first chamber 241 from the inlet 223 depending on the position of the first diverter. In other words, when the first diverter 251 is in the second position, the first chamber 241 and the second chamber 242 may be fluidly connected to the inlet 223 by the first diverter 251; and when the first diverter 251 is in the first position, the first chamber 241 may be fluidly disconnected from the inlet 223 by the sealing member 271 and the first diverter 251.

The valve 239 may optionally include a biasing member that is configured to bias the first diverter 251 in a direction. As shown in FIGS. 8 and 46, the biasing member 245 is in the form of a coil spring (e.g., a helical spring, a compression spring, an extension spring, etc.) configured to bias the first diverter 251 from the second position (e.g., the user depressed position) toward the first position (e.g., the pre-user depressed position). In this arrangement, a force from the biasing member may advantageously be in an opposing (e.g., counteracting) direction than the force of the user depressing the first actuator 224. When the user depresses the first actuator 224, such as to the second position, the biasing member 245 is compressed thereby storing energy. Once the user releases the force depressing the first actuator 224, the biasing member 245 exerts a force from the stored energy to return the first actuator 224 to the first position.

The biasing member 245 may have a first portion (e.g., a first end) that engages the first diverter 251 and a second portion (e.g., a second end) that engages a portion of another element of the valve 239 to impart a biasing force between the first diverter 251 and the other element. As shown, the second end 251*b* of the first diverter 251 includes a bore 251*f* that receives a post 240*c* of the body 240 with the biasing member 245 disposed in the bore 251*f* between the post 240*c* and the second end 251*b* of the first diverter 251. The bore 251*f* may have a generally cylindrical shape, according to one example, to receive and retain the biasing member 245 in the form of a coil spring. The post 240*c* may be disposed on the first portion 240*a* of the body 240, and may have a generally cylindrical shape, according to one example. The post 240*c* may also help guide movement of the first diverter 251, such as by maintaining the position (e.g., the radial position, etc.) of the first diverter 251 relative to the body 240 as the first diverter 251 moves between the first and second positions in the radial direction. This arrangement may advantageously help the first diverter 251 provide a good and repeatable seal with the body 240.

Also shown in FIG. 8, the first chamber 241 includes a first portion 241*a* that receives at least a portion of the first diverter 251 therein. The first portion 241*a* may be configured to extend in the radial direction R (which may be transverse to the longitudinal direction L), such that the first diverter 251 moves in the radial direction R within the first portion 241*a* between the first and second positions. The first chamber 241 may further include a second portion 241*b* that is fluidly connected to an outlet (e.g., an outlet member). As shown in FIG. 7, the second portion 241*b* is fluidly connected to the first outlet member 231, such that fluid passing through the first chamber 241 exits the sprayhead 210 through the first plurality of nozzles 231*a* of the first outlet member 231. Also shown, the sprayhead 210 may include two parallel second portions 241*b*, where each second portion 241*b* extends along one of the two opposing sides of the body 240. Each second portion 241*b* may be configured to extend at an angle relative to the first portion 241*a*. For example, each second portion 241*b* may extend in a transverse direction (e.g., the longitudinal direction) relative to the radially extending first portion 241*a*.

The valve 239 may optionally include additional elements (e.g., components, members, etc.) to help retain the first diverter 251 and/or seal the first chamber 241. As shown in FIGS. 8-12, the valve 239 includes a support sleeve 246 and a retaining member 247. In addition, the valve 239 may include a plurality of different sealing members disposed on various components of the sprayhead 210 to allow for fluidly connecting and fluidly disconnecting the various chambers of the sprayhead, to thereby provide multiple spray functions. According to an exemplary embodiment, the first diverter 251, the second diverter 252, an outlet member, body 240, or any other component of the sprayhead 210 may include one or more sealing members (e.g., O-rings, etc.) disposed thereon.

Figure 11:
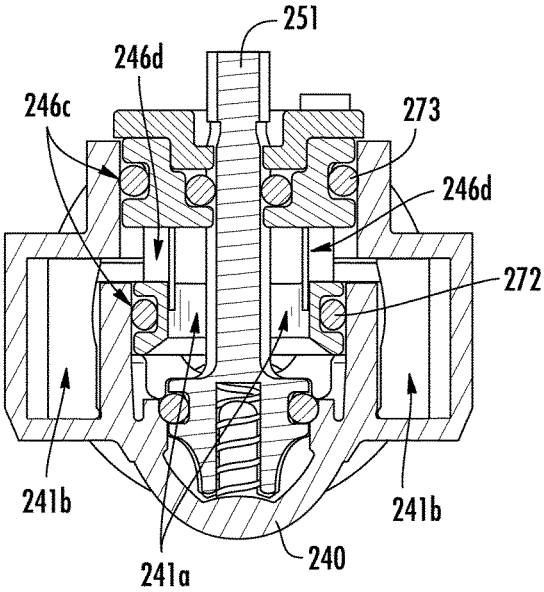
FIG. 11 is a front view of the cross-section of the portion of the sprayhead of FIG. 10.

The support sleeve 246 may be disposed in the first portion 241*a* of the first chamber 241 to support the first diverter 251, such as during movement thereof. The support sleeve 246 may include an outer wall 246*a* that is shaped to complement the shape of the body 240 (e.g., walls thereof defining the first portion 241*a*) to maintain the relative position between the support sleeve 246 and the body 240. The outer wall 246*a* may include one or more than one channel that is configured to receive a corresponding number of sealing members therein. As shown in FIG. 11, the outer wall 246*a* includes two offset generally C-shaped (e.g., cross-sectional) channels 246*c* configured to receive the sealing members 272, 273 therein to provide seals between the support sleeve 246 and the body 240. The outer wall 246*a* includes one or more openings 246*d*, such as one or two pair of opposing openings, that allow fluid to flow from the first portion 241*a* to the second portion 241*b* of the first chamber 241. The support sleeve 246 also includes an inner wall 246*b* that extends inwardly from the outer wall 246*a* and is configured to help maintain the position (e.g., concentricity) of the first diverter 251 (e.g., an end thereof) relative to the body 240. The inner wall 264*b* may include an opening defining an inner surface, which may contact an outer surface of the first diverter 251 to maintain the relative position of the diverter, and act as a guide to the diverter during its movement.

Figure 12:
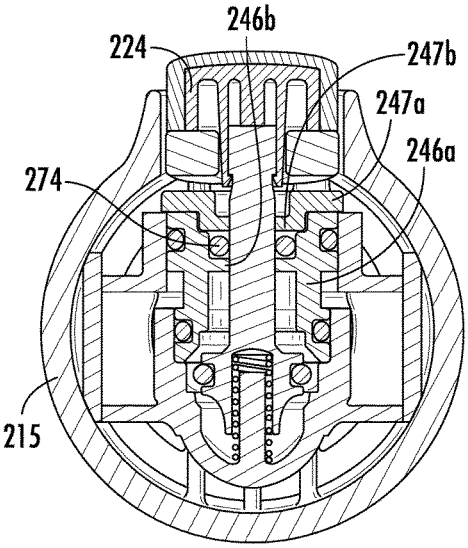
FIG. 12 is another front cross-sectional view of the sprayhead of FIG. 1.

The retaining member 247 may be configured to retain other elements (e.g., the support member 246) in place in the valve 239. As shown in FIG. 12, the retaining member 247 includes an upper wall 247*a* and a lower wall 247*b*. The upper wall 247*a* may be configured to engage the body 240, such as a channel (as shown in FIG. 8) of the first portion 240*a*, to secure the retaining member 247 in place relative to the body 240. The upper wall 247*a* and/or the lower wall 247*b* may be configured to retain the support member 246 in place, such as by contacting a portion of the support member 246 to prohibit the support member 246 from moving out of the first chamber 241. The lower wall 247*b* may extend away from the upper wall 247*a* toward the support member 246, and include an opening therein that a portion of the first diverter 251 may pass through. Thus, the lower wall 247*b* includes an inner surface that is configured to support the first diverter 251, such as through an abutting arrangement. A cavity may be formed between the inner wall 246*b* of the support member 246, the lower wall 247*b* of the retaining member 247, and the first diverter 251, where the cavity receives the sealing member 274 therein to form a seal between these elements of the sprayhead 210.

According to an exemplary embodiment, the second diverter 252 is movable between a first position and a second position. FIG. 8 illustrates the second diverter 252 in the second position (e.g., forward position, left-side position) and the first diverter 251 in the first position. In the first position, the second diverter 252 is in a rearward or right-side position (i.e., where it is moved from left to right in FIG. 8). When the second diverter 252 is in the second position, the third chamber 243 is fluidly connected to (e.g., in fluid communication with) the second chamber 242, such that fluid flow is directed from the second chamber 242 to the third chamber 243. When the second diverter 252 is in the first position, the third chamber 243 is fluidly disconnected from the second chamber 242, such that no fluid is directed into the third chamber 243 from the second chamber 242. For example, the second outlet member 232 (or a chamber leading thereto) may be fluidly connected to the second chamber 242, when the second diverter 252 is in its first position.

As shown in FIGS. 7 and 8, when the second diverter 252 is in the second position, the fluid flows from the second chamber 242 through the third chamber 243 to the third outlet member 233 to provide the third spray function (e.g., mode of operation) of the sprayhead 210. Thus, the second plurality of nozzles 233*a*' of the third outlet member 233 are fluidly connected to the third chamber 243 in this configuration. When the second diverter 252 is in the first position, the second fluid flow 332*a* from the second chamber 242 is provided to the second outlet member 232 to provide a second spray function of the sprayhead 210. Thus, the at least one nozzle 232*a* of the second outlet member 232 is fluidly connected to the second chamber 242 in this configuration. The second chamber 242 may include more than one portion. For example, the second chamber 242 may include a first portion that is fluidly connected to the inlet 223, such as when the first diverter 251 is in the second position, and may also include a second portion that is fluidly connected to the first portion of the second chamber 242, such as when the second diverter 252 is in the first position. The second portion of the second chamber 242, if provided, may be fluidly connected to the second outlet member 232. According to an exemplary embodiment, the second outlet member 232 may be aligned with the second diverter 252, and therefore aligned with the third chamber 243. For this example, the second portion of the second chamber 242 may be provided between the second outlet member 232 and the second diverter 252. The second portion of the second chamber 242, as described above, may alternatively be configured as a lead-in chamber to the second outlet member 232, which fluidly connects the second chamber 242 and the second outlet member 232, such as when the second diverter 252 is in its first position.

As shown in FIGS. 7 and 8, the second diverter 252 is configured to move within the body 240 in the longitudinal direction L between the first and second positions. For example, at least a portion of the second diverter 252 may be disposed in a portion of the third chamber 243, such that the second diverter 252 moves in the longitudinal direction L within the portion of the third chamber 243. Actuation of the second actuator 225 between its positions moves the second diverter 252. For example, a slider 235 may be operatively coupled to the second diverter 252 and the second actuator 225, such that actuation of the second actuator 225 moves (e.g., slides, translates, etc.) the slider 235 and in-turn moves the second diverter 252 between the first and second positions. The second actuator 225 is configured to function independently of the first actuator 224, so as to separately control movement of the second diverter 252.

According to the exemplary embodiment of FIGS. 8-9B, a pivotable member 236 may be operatively coupled between the first actuator 224 and the slider 235. The pivotable member 236 is configured such that actuation of the first actuator 224 rotates or pivots the pivotable member 236, which in-turn moves (e.g., slides, translates, etc.) the slider 235, which moves the second diverter 252 between the first and second positions. In this way, actuation of the first actuator 224 can cause a simultaneous spray from the third outlet member 233 and from the first outlet member 231. Actuation of the second actuator 225 can also cause the pivotable member 236 to rotate or pivot to move the slider 235, which in turn will move only the second diverter 252 between the first and second positions. In this way, actuation of the second actuator 225 can cause a spray from the third outlet member 233 or the second outlet member 232, independently of the first outlet member 231.

For example, FIG. 9A illustrates the sprayhead 210 with the second diverter 252 at the first position and the first actuator 224 at the first position (e.g., the non-depressed position). In this position, the first chamber 241 is fluidly disconnected from the inlet and the second chamber 242 is fluidly connected to the inlet 223, so as to provide the second fluid flow 332*a* to the second outlet member 232. When a user actuates the first actuator 224 by applying a force to the actuator (e.g., by pressing the actuator 224), as generally indicated by arrow "A" in FIG. 9B, a first fluid flow 331*a* from the inlet 223 will enter the first chamber 241 and will pass through the plurality of nozzles 231*a* of the first outlet member 231 to provide the first spray function of the sprayhead 210. The direction of travel of the first fluid flow 331*a* within the sprayhead 210 is further illustrated in the cross-sectional view of FIG. 7. Actuation of the first actuator 224 will also cause the pivotable member 236 to pivot or rotate in an angular direction indicated by arrow "C" about an axis C', which in-turn causes the slider 235 to move in a longitudinal direction indicated generally by arrow "B." The movement of the slider 235 in the direction indicated by arrow "B" causes the second diverter 252 to move to the second position. This will cause a third fluid flow 333*a* from the second chamber 242 through the third chamber 243 to the third outlet member 233, to thereby provide the third spray function simultaneously with the first spray function of the sprayhead 210. In addition, actuation of the first actuator 224 will cause the second actuator 225 to rotate/pivot to the second, rearward position.

As previously explained with reference to FIG. 39, the simultaneous functionality of the first and third spray functions is particularly advantageous, because the third spray 333 (i.e., third fluid flow 333*a*) provided by the third outlet member 233 can act as a curtain or shield by surrounding the first spray 331 (i.e., first fluid flow 331*a*) provided by the first outlet member 231. In this manner, the curtain or shield of spray 333 provided by the third outlet member 233 can act to substantially impede or reduce the amount of splashing that may result from the first spray 331 contacting and deflecting from a surface of an object by substantially containing the first spray 331 (e.g., dishware, utensils, food products, etc.).

Figure 40:
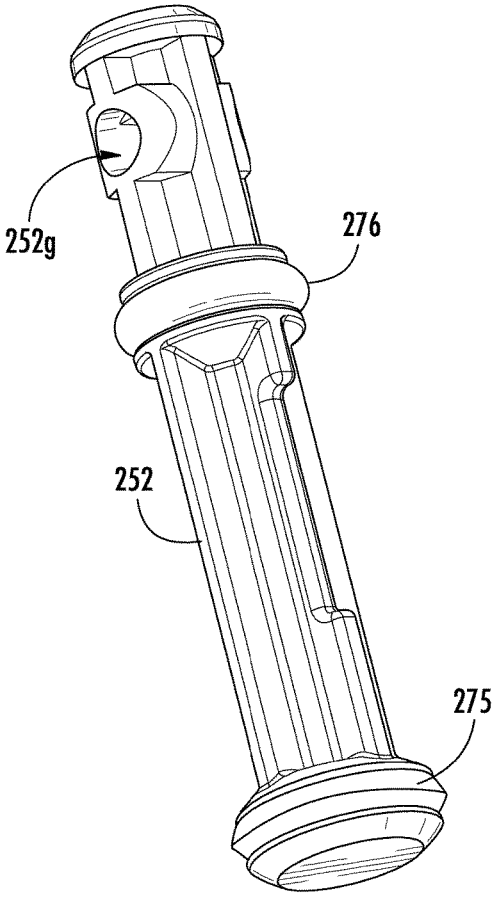
FIG. 40 is a perspective view of an exemplary embodiment of a diverter assembly of a sprayhead.

FIGS. 40-43 illustrate an exemplary embodiment of the second diverter 252. FIG. 40 also illustrates optional sealing members 275, 276 coupled to the second diverter 252, which may help form a seal between the second diverter 252 and the body 240. The second diverter 252 includes a first end 252*a*, a second end 252*b*, and a sealing portion 252*c*. As shown in FIGS. 7 and 8, the sealing portion 252*c* is configured to provide a seal between the second diverter 252 and a portion of the valve 239 (e.g., a portion of the body 240) to prevent fluid from passing beyond the seal. For example, the sealing portion 252*c* may seal-off the second outlet member 232 from the second chamber 242 to prevent fluid from passing from the second chamber 242 to the second outlet member 232 when the second diverter 252 is in the second position. Also, for example, the sealing portion 252*c* may seal-off the third chamber 243 from the second chamber 242 to prevent fluid from passing from the second chamber 242 to the third chamber 243 when the second diverter 252 is in the first position.

Figure 41:
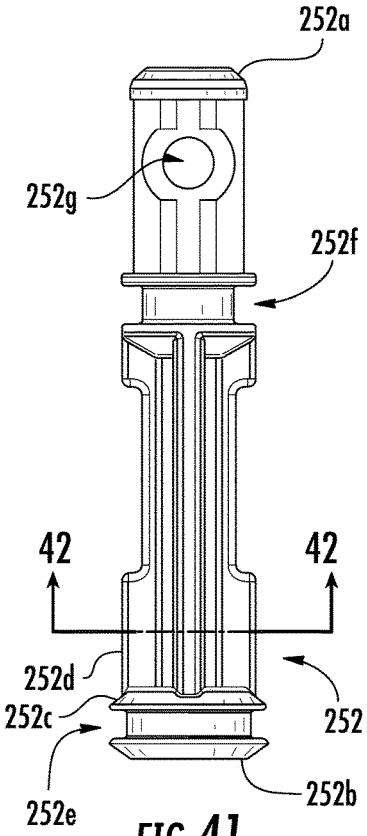
FIG. 41 is a top view of an exemplary embodiment of a diverter of a diverter assembly.
Figure 42:
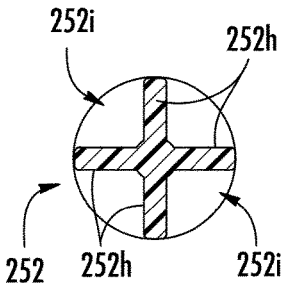
FIG. 42 is a front cross-sectional view the diverter of FIG. 41.
Figure 43:
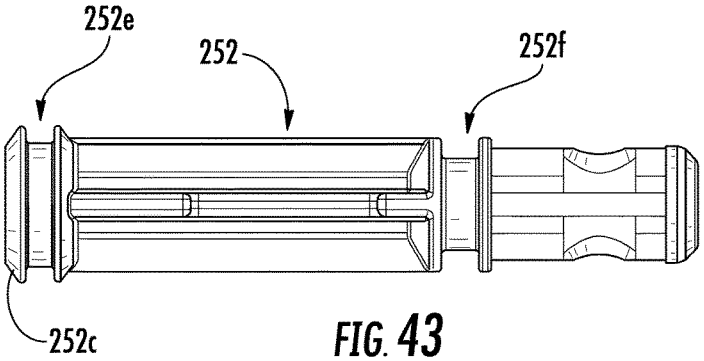
FIG. 43 is a side view the diverter of FIG. 41.
Figure 45:
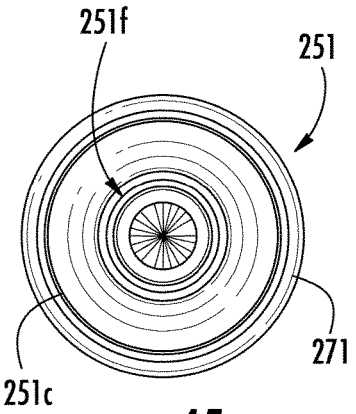
FIG. 45 is a top view of the diverter assembly of FIG. 44.
Figure 44:
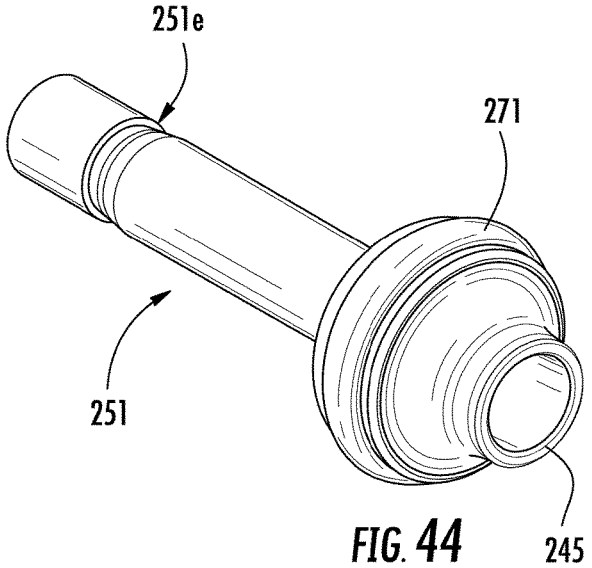
FIG. 44 is a perspective view of another exemplary embodiment of a diverter assembly of a sprayhead.

As shown in FIGS. 40-43, the second diverter 252 is configured generally as a piston (e.g., has a piston shape), with the sealing portion 252*c* extending away from a body 252*d*. The sealing portion 252*c* is disposed on the second end 252*b* of the second diverter 252 in the example shown. However, the sealing portion 252*c* may be provided anywhere along the body 252*d* between the first and second ends 252*a*, 252*b*. The sealing portion 252*c* has a generally cylindrical shape, conical shape, or any suitable shape that may be tailored to the geometry of the valve 239 (e.g., the body 240). As shown in FIGS. 41 and 43, the sealing portion 252*c* is configured as a shoulder that extends away from the body 252*d*, which may include an optional channel 252*e* provided therein. The channel 252*e* may be recessed into the shoulder of the sealing portion 252*c*, such that the sealing portion 252*c* has a generally C-shaped cross-section to receive the sealing member 275 in the form of an o-ring in the channel 252*e*. Thus, sides of the sealing portion 252*c* retain the sealing member 275 in the channel 252*e*. For the configuration including the sealing member 275, the sealing member 275 may, either alone or in cooperation with the sealing portion 252*c*, fluidly disconnect the third chamber 243 or the second outlet member 232 from the second chamber 242, depending on the position of the second diverter 252.

The second diverter 252 may include one or more additional channels 252*f* configured to receive one or more additional sealing members 276. Also shown in FIGS. 40 and 43, the second diverter includes a second channel 252*f* provided along the body 252*d* at a distance that is beyond the third chamber 243 to provide a seal between the second diverter 252 and the body 240 on the upstream side of the third chamber 243 (see FIG. 8, which shows the sealing member 276 provided to outside of the third chamber 243).

The second diverter 252 may include an opening 252*g* that is configured to receive a portion of the slider 235 therein to operatively couple the second diverter 252 and the slider 235. As shown in FIGS. 40 and 41, the opening 252*g* is disposed in the first end 252*a* of the second diverter 252 and has a generally cylindrical shape (e.g., having a circular cross-sectional shape). However, the shape and location of the opening 252*g* may be tailored to the shape and location of the slider 235 and/or the valve 239 in general.

Figure 15:
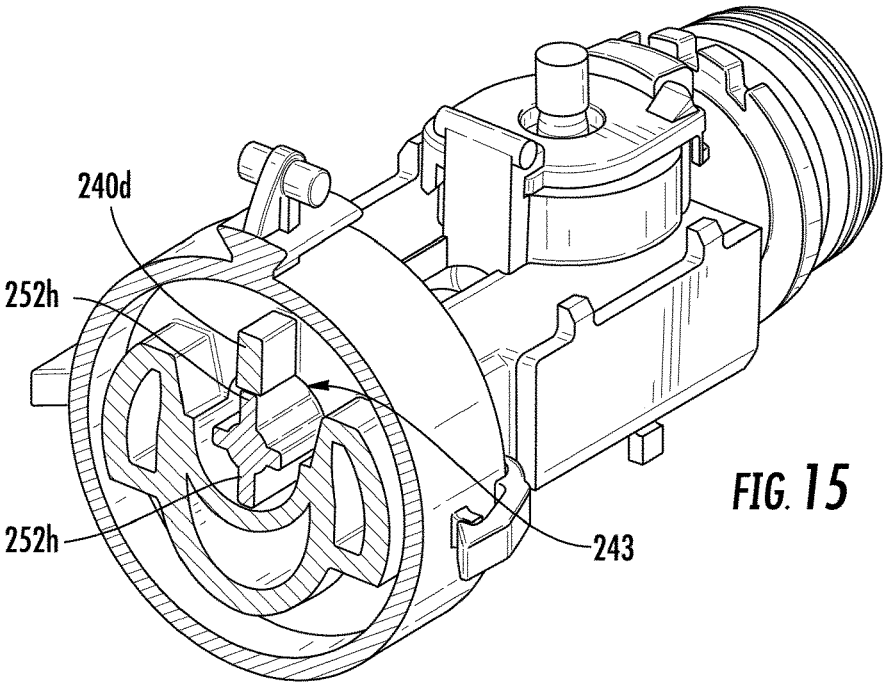
FIG. 15 is another perspective cross-sectional view of a portion of the sprayhead of FIG. 1.
Figure 16:
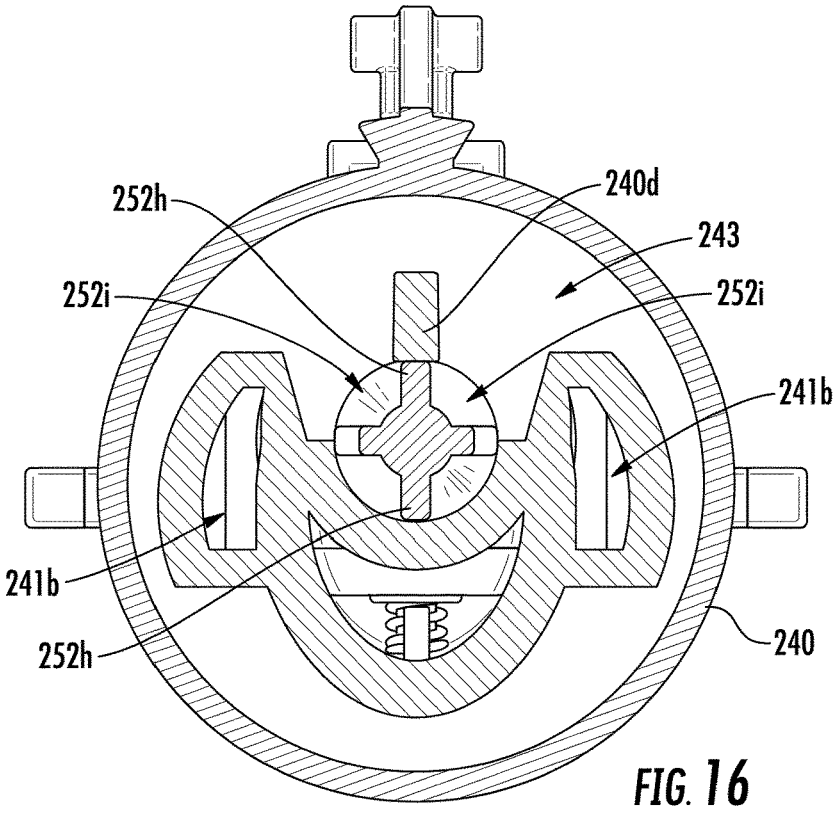
FIG. 16 is a front view of the cross-section of the portion of the sprayhead of FIG. 15.
Figure 17:
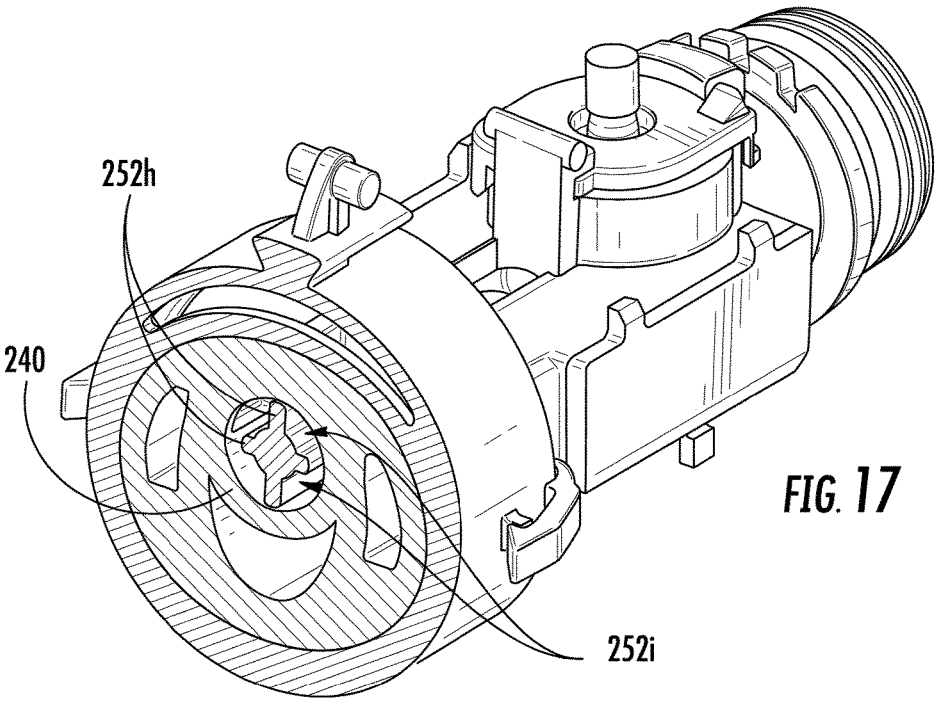
FIG. 17 is another perspective cross-sectional view of a portion of the sprayhead of FIG. 1.

The portion of the body 252*d* provided adjacent to the third chamber 243 may be configured having a shape that allows fluid to pass from the second chamber 242 to the third chamber 243 when the second diverter 252 is in the second position. As shown in FIG. 42, the body 252*d* includes a plurality of radial extending ribs 252*h* (e.g., members, sections, etc.) having open spaces 252*i* between each pair of adjacent ribs 252*h*. This arrangement advantageously allows fluid to flow through the open spaces 252*i* to the third chamber 243 when the second diverter 252 is in the second position, while providing strength and stability during movement, since the ends of the ribs 252*h* may be guided by portions of the body 240. FIGS. 15 and 16 show opposing guide portions 240*d* of the body 240 that guide the ends of the opposing ribs 252*h*, as well as the fluid connection between the open spaces 252*i* and the third chamber 243. As shown, the body 240 may include an open section (e.g., along the longitudinal axis L) around the body 252*d* of the second diverter 252, such that all of the open spaces 252*i* are fluidly connected to the third chamber 243. As shown in FIG. 17, the body 240 may also include a closed section around the body 252*d* of the second diverter 252, such that all of the ends of the ribs 252*h* are supported by an inner surface of the body 240. Thus, the open and closed sections are provided at different locations along the longitudinal axis L.

Figure 13:
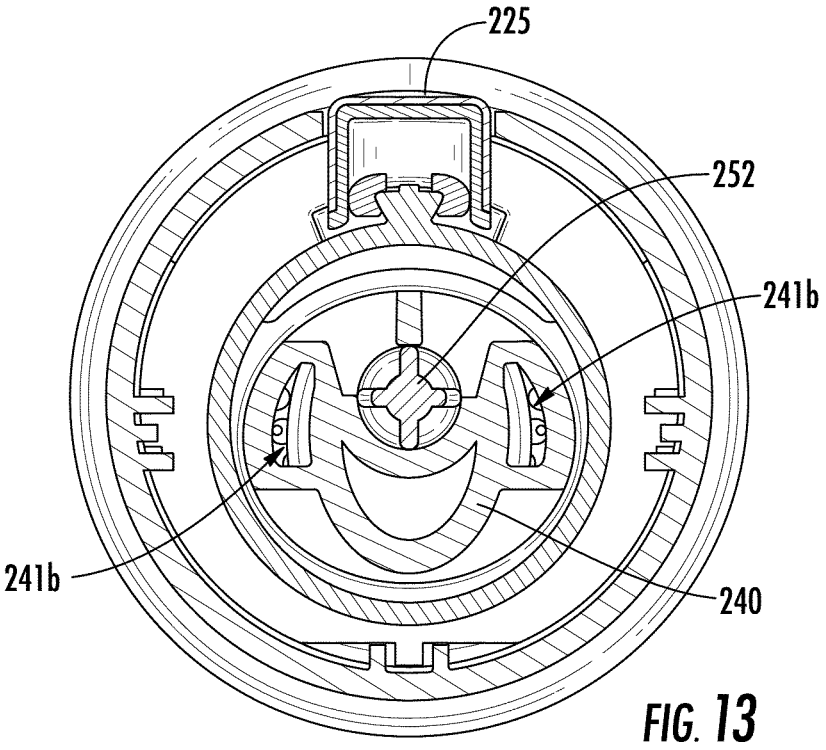
FIG. 13 is another front cross-sectional view of the sprayhead through line 13-13 of FIG. 7.
Figure 14:
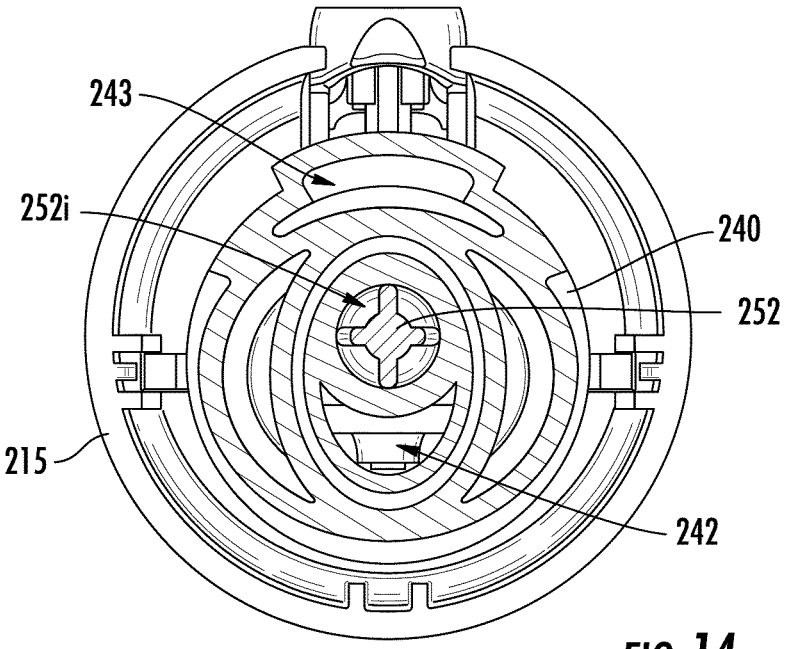
FIG. 14 is another front cross-sectional view of the sprayhead through line 14-14 of FIG. 7.
Figure 18:
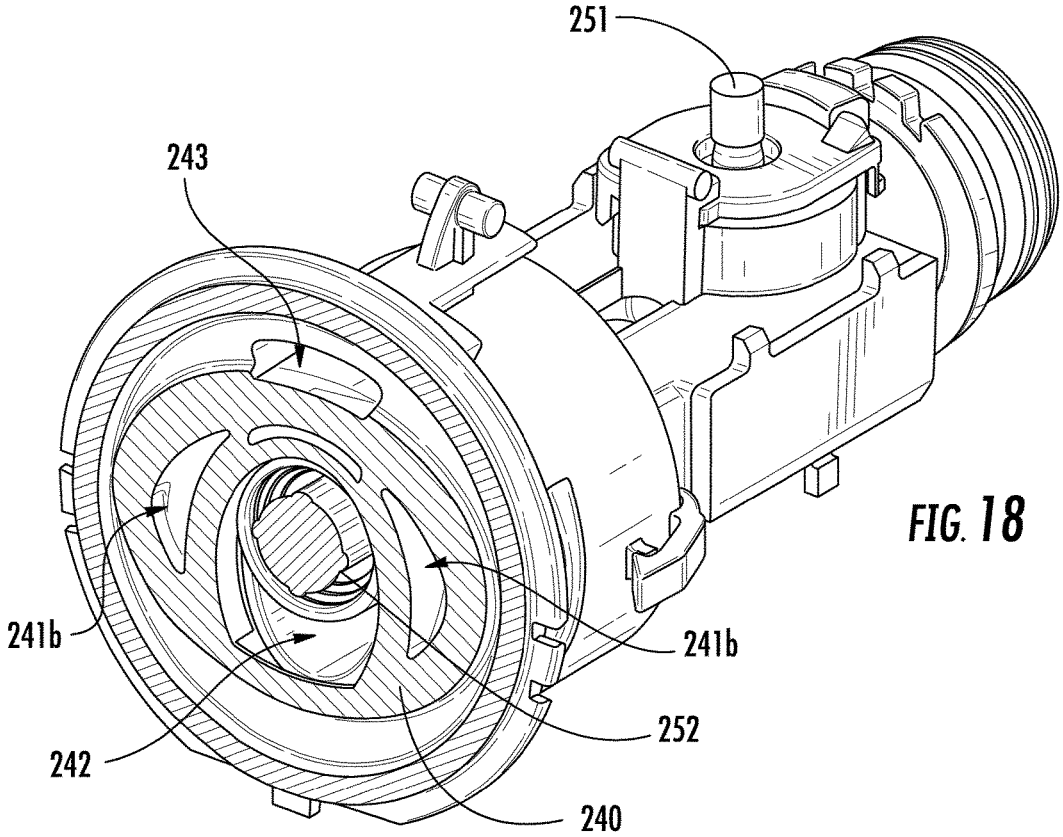
FIG. 18 is another perspective cross-sectional view of a portion of the sprayhead of FIG. 1.
Figure 19:
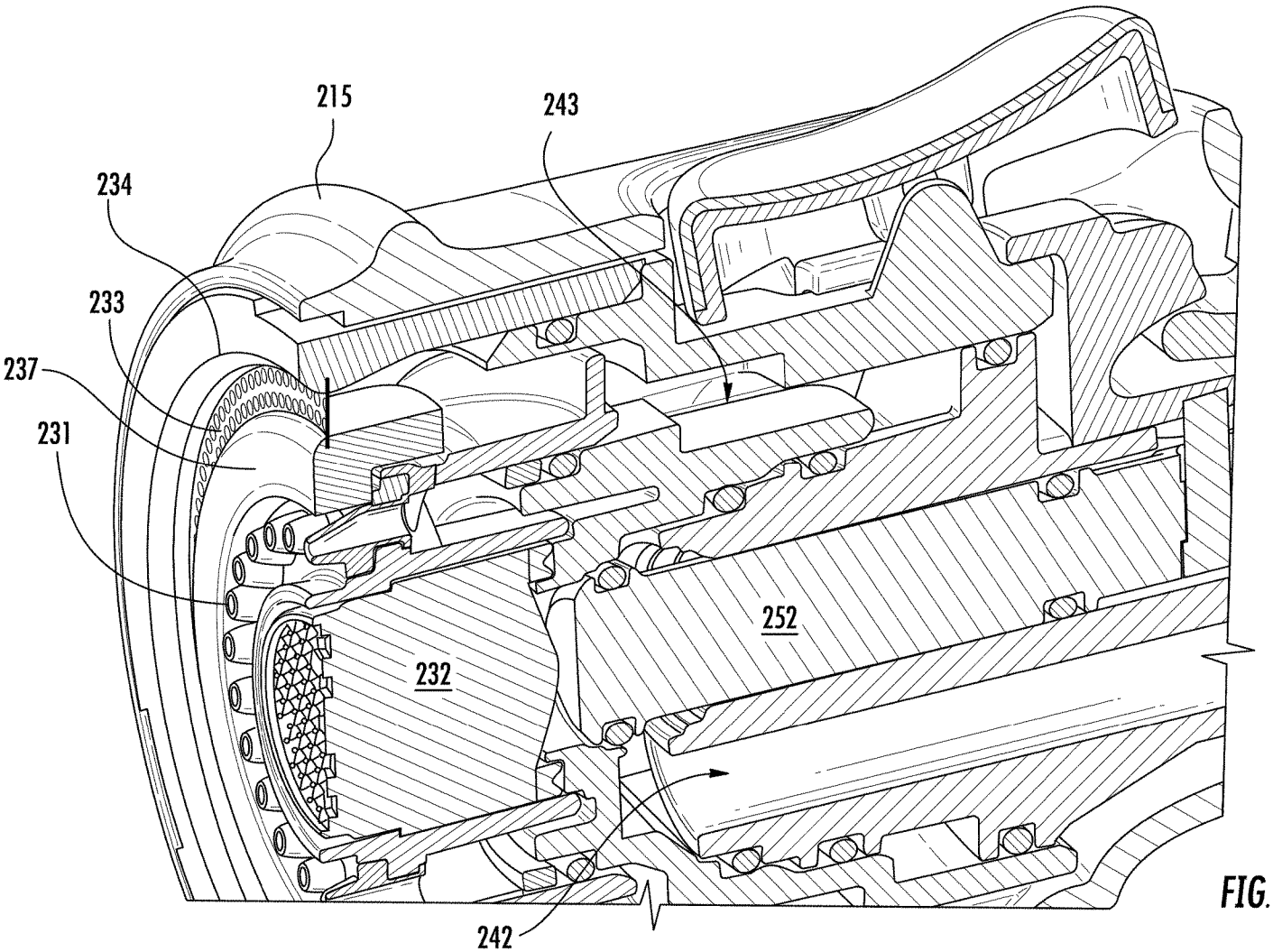
FIG. 19 is a perspective cross-sectional view of a portion of the sprayhead of FIG. 1.

FIGS. 13-19 illustrate various cross-sectional views to further illustrate the fluid flow through the sprayhead 210, such as the body 240. FIG. 13 shows the second portions 241*b* of the first chamber 241. FIG. 14 shows the second chamber 242, as well as the open spaces 252*i* that are fluidly connected to the third chamber 243. FIG. 18 shows the second portions 241*b* of the first chamber 241, the second chamber 242, the third chamber 243, the first diverter 251, the second diverter 252, and the body 240. FIG. 19 shows the first, second, and third outlet members 231, 232, 233, as well as the second and third chambers 242, 243.

The sprayhead 210 may optionally include a screen member 281 disposed in the inlet 223 to filter any debris or sediment that may pass into the inlet 223 of the sprayhead 210. As shown in FIG. 7 the screen member 281 may be disposed in the inlet 223. The screen member 281 may be a mesh screen that is configured to a predetermined size (e.g., orifice, porosity, etc.). A flow control 282 (e.g., collar) may optionally be provided adjacent to the screen member 281. The flow control 282 and/or the screen member 281 may couple to the sprayhead 210, such as to the body 240. For example, the inner surface of the body 240 defining the inlet 223 may include a detent member (e.g., raised member) that detachably secures the screen member 281 and flow control 282 in place in the inlet 223.

The sprayhead 210 may optionally include additional sealing members 277 to provide further seals in the valve 239 and/or the sprayhead 210. For example, one or more sealing members 277 may be provided between the first portion 240*a* and the second portion 240*b* of the body 240. Also, for example, one or more sealing members 277 may be provided between the second portion 240*b* of the body 240 and the outlet members, such as the first outlet member 231 and the third outlet member 233.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the sprayheads as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., valves, bodies, diverters, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A fluid control valve, comprising:

a body comprising an inlet configured to receive a supply of fluid, a first chamber, a third chamber, a first outlet associated with the first chamber, and a third outlet associated with the third chamber;

a first diverter movable in a radial direction within the body between a first radial position and a second radial position;

a second diverter movable in a longitudinal direction within the body between a first longitudinal position and a second longitudinal position; and a first actuator operatively coupled to the first diverter and to the second diverter;

wherein the first actuator is configured to simultaneously move the first diverter between the first and second radial positions and the second diverter between the first and second longitudinal positions; and wherein the first chamber and the third chamber are each configured to be fluidly connected to the inlet in response to actuation of the first actuator so as to simultaneously provide two different sprays of fluid from the first and third outlets, respectively.

2. The fluid control valve of claim 1, further comprising:

a second actuator operatively coupled to the second diverter; and a slider coupled between the second actuator and the second diverter;

wherein the second actuator is configured to move the second diverter between the first and second longitudinal positions via the slider; and wherein the second actuator is configured to move the second diverter independently of the first actuator.

3. The fluid control valve of claim 2, further comprising:

a pivotable member operatively coupled between the slider and the first actuator;

wherein the pivotable member is configured to pivot about an axis to cause the slider to move in a longitudinal direction to thereby move the second diverter between the first and second longitudinal positions when the first actuator is actuated.

4. The fluid control valve of claim 1, wherein the second diverter is oriented perpendicular to the first diverter.

5. The fluid control valve of claim 1, wherein the body further comprises:

a second chamber;

wherein the second chamber is fluidly connected to the inlet and the first chamber is fluidly disconnected from the inlet when the first diverter is in the first radial position;

wherein the first and second chambers are fluidly connected to the inlet when the first diverter is in the second radial position;

wherein the third chamber is fluidly disconnected from the second chamber when the second diverter is in the first longitudinal position; and wherein the third chamber is fluidly connected to the second chamber when the second diverter is in the second longitudinal position.

6. The fluid control valve of claim 5, wherein the body further comprises:

a second outlet;

wherein the second outlet is fluidly connected to the second chamber when the second diverter is in the first longitudinal position; and wherein the second outlet is fluidly disconnected from the second chamber when the second diverter is in the second longitudinal position.

7. The fluid control valve of claim 6, wherein at least a portion of the second diverter is disposed in a portion of the third chamber that extends in a longitudinal direction through the body, such that the second diverter moves in the longitudinal direction between the first and second longitudinal positions.

8. The fluid control valve of claim 7, wherein the first chamber includes a first portion that receives at least a portion of the first diverter and a second portion that is fluidly connected to the first outlet, wherein the first portion of the first chamber extends in a radial direction that is transverse to the longitudinal direction such that the first diverter moves in the radial direction between the first and second radial positions, and wherein the second portion of the first chamber extends at an angle relative to the first portion.

9. A fluid control valve, comprising:

a body comprising an inlet configured to receive a supply of fluid, a first chamber, a third chamber, a first outlet associated with the first chamber, and a third outlet associated with the third chamber;

a first diverter movable in a first direction within the body;

a second diverter movable in a second direction within the body, wherein the second direction is different than the first direction; and a first actuator operatively coupled to the first diverter and to the second diverter;

wherein the first actuator is configured to simultaneously move the first diverter and the second diverter so as to direct the supply of fluid through the first chamber and the third chamber to simultaneously provide two different sprays of fluid from the first and third outlets, respectively.

10. The fluid control valve of claim 9, further comprising:

a second actuator operatively coupled to the second diverter; and a slider coupled between the second actuator and the second diverter;

wherein the second actuator is configured to move the second diverter between a first longitudinal position and a second longitudinal position via the slider; and wherein the second actuator is configured to move the second diverter independently of the first actuator.

11. The fluid control valve of claim 10, further comprising:

a pivotable member operatively coupled between the slider and the first actuator;

wherein the pivotable member is configured to pivot about an axis to cause the slider to move in a longitudinal direction to thereby move the second diverter between the first and second longitudinal positions when the first actuator is actuated.

12. The fluid control valve of claim 9, wherein the second diverter is oriented perpendicular to the first diverter.

13. The fluid control valve of claim 9, wherein the body further comprises:

a second chamber;

wherein the second chamber is fluidly connected to the inlet and the first chamber is fluidly disconnected from the inlet when the first diverter is in a first radial position;

wherein the first and second chambers are fluidly connected to the inlet when the first diverter is in a second radial position;

wherein the third chamber is fluidly disconnected from the second chamber when the second diverter is in a first longitudinal position; and wherein the third chamber is fluidly connected to the second chamber when the second diverter is in a second longitudinal position.

14. The fluid control valve of claim 13, wherein the body further comprises:

a second outlet;

wherein the second outlet is fluidly connected to the second chamber when the second diverter is in the first longitudinal position; and wherein the second outlet is fluidly disconnected from the second chamber when the second diverter is in the second longitudinal position.

15. The fluid control valve of claim 14, wherein at least a portion of the second diverter is disposed in a portion of the third chamber that extends in a longitudinal direction through the body, such that the second diverter moves in the longitudinal direction between the first and second longitudinal positions.

16. The fluid control valve of claim 15, wherein the first chamber includes a first portion that receives at least a portion of the first diverter and a second portion that is fluidly connected to the first outlet, wherein the first portion of the first chamber extends in a radial direction that is transverse to the longitudinal direction such that the first diverter moves in the radial direction between the first and second radial positions, and wherein the second portion of the first chamber extends at an angle relative to the first portion.

17. A fluid control valve, comprising:

a body comprising an inlet configured to receive a supply of fluid, a first chamber, a third chamber, a first outlet member associated with the first chamber, and a third outlet member associated with the third chamber;

a first diverter movable in a first direction within the body;

a second diverter movable in a second direction within the body, wherein the second direction is different than the first direction;

a first actuator operatively coupled to the first diverter and to the second diverter;

a second actuator operatively coupled to the second diverter;

wherein the first actuator is configured to simultaneously move the first diverter and the second diverter so as to direct the supply of fluid through the first chamber and the third chamber to simultaneously provide two different sprays of fluid from the first and third outlets, respectively;

wherein the second actuator is configured to move the second diverter independently of the first actuator.

18. The fluid control valve of claim 17, further comprising:

a slider coupled between the second actuator and the second diverter;

wherein the second actuator is configured to move the second diverter between a first longitudinal position and a second longitudinal position via the slider.

19. The fluid control valve of claim 18, further comprising:

a pivotable member operatively coupled between the slider and the first actuator;

wherein the pivotable member is configured to pivot about an axis to cause the slider to move in a longitudinal direction to thereby move the second diverter between the first and second longitudinal positions when the first actuator is actuated.

20. The fluid control valve of claim 19, wherein the second diverter is oriented perpendicular to the first diverter.

* * * * *